US007281561B2

(12) United States Patent
Anderson et al.

(10) Patent No.: US 7,281,561 B2
(45) Date of Patent: Oct. 16, 2007

(54) MULTI-LAYERED FILM WINDOW SYSTEM

(76) Inventors: Donald Anderson, 104 E. 8th St., Northfield, MN (US) 55057; Clifford Taylor, 806 E. Ridge Dr., Northfield, MN (US) 55057

( * ) Notice: Subject to any disclaimer, the term of this patent is extended or adjusted under 35 U.S.C. 154(b) by 218 days.

(21) Appl. No.: 10/862,671

(22) Filed: Jun. 7, 2004

(65) Prior Publication Data

US 2005/0269041 A1 Dec. 8, 2005

(51) Int. Cl.
*E06B 9/08* (2006.01)
*E06B 3/00* (2006.01)
*E05F 1/04* (2006.01)

(52) U.S. Cl. ..... 160/121.1; 49/242; 52/204.5

(58) Field of Classification Search ..... 160/121.1, 160/98, 310, 133, 6; 49/242, 31; 52/204.5, 52/204.51, 204.6, 204.593
See application file for complete search history.

(56) References Cited

U.S. PATENT DOCUMENTS

| | | | | | |
|---|---|---|---|---|---|
| 406,930 | A * | 7/1889 | Chass | 213/192 |
| 3,903,665 | A | 9/1975 | Harrison | |
| 4,039,019 | A * | 8/1977 | Hopper | 160/121.1 |
| 4,158,718 | A | 6/1979 | Kehl | |
| 4,187,896 | A | 2/1980 | Shore | |
| 4,417,185 | A | 11/1983 | Bullat | |
| 4,506,720 | A * | 3/1985 | Iwanicki | 160/26 |
| 4,604,840 | A * | 8/1986 | Mondon | 52/172 |
| 4,649,980 | A * | 3/1987 | Kunz | 160/98 |
| 4,789,582 | A | 12/1988 | Brill | |
| 5,007,217 | A * | 4/1991 | Glover et al. | 52/172 |
| 5,566,736 | A * | 10/1996 | Crider et al. | 160/121.1 |
| 5,819,835 | A * | 10/1998 | Broome | 160/243 |
| 5,960,847 | A * | 10/1999 | Crider et al. | 160/121.1 |
| 6,060,852 | A | 5/2000 | Domel | |
| 6,082,433 | A | 7/2000 | Vafaie | |
| 6,137,629 | A * | 10/2000 | Shopp | 359/461 |
| 6,138,738 | A * | 10/2000 | Moller et al. | 160/98 |
| 6,201,364 | B1 | 3/2001 | Will | |
| 6,691,761 | B1 * | 2/2004 | Alkhoury et al. | 160/273.1 |

* cited by examiner

*Primary Examiner*—Hugh B. Thompson, II
*Assistant Examiner*—Candace L. Bradford
(74) *Attorney, Agent, or Firm*—DL Tschida

(57) ABSTRACT

A high R-rating window assembly storing multiple, reciprocating reflective flexible film layers in a sealed housing between rigid (e.g. glazed) layers. The glazed layers are separated on the order of 3 to 5-inches and are secured to low thermal conductivity framework pieces. The framework is capped with a motorized roller and film housing and the assembly is evacuated and filled with a desiccated, inert dry gas. Several plastic, reflective coated films are supported under tension in planar parallel relation between the glazing layers from the motorized roller and several guide rollers and guide tracks. Location sensors responsive to indicia on the films identify film position. Temperature sensors monitor ambient, internal and user set thermal conditions to control film exposure. The films are operable via a room control system and window controllers to define open, closed and partial exposure conditions. Alternative control functions may control film exposure in relation to room occupancy.

56 Claims, 16 Drawing Sheets

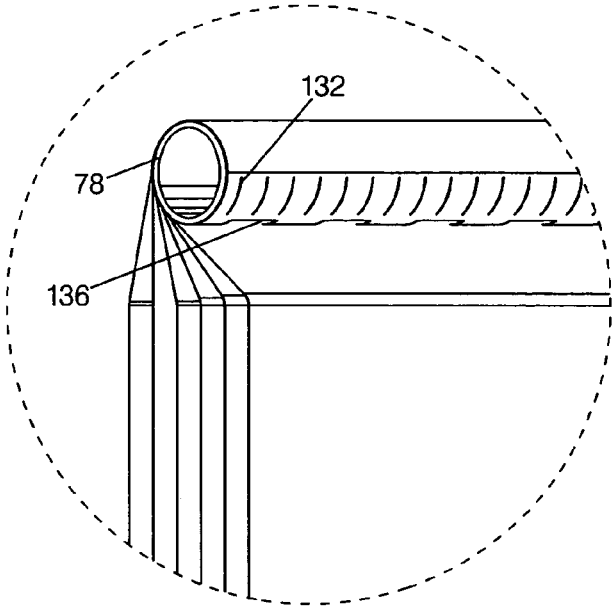
FIG. 9
FIG. 8
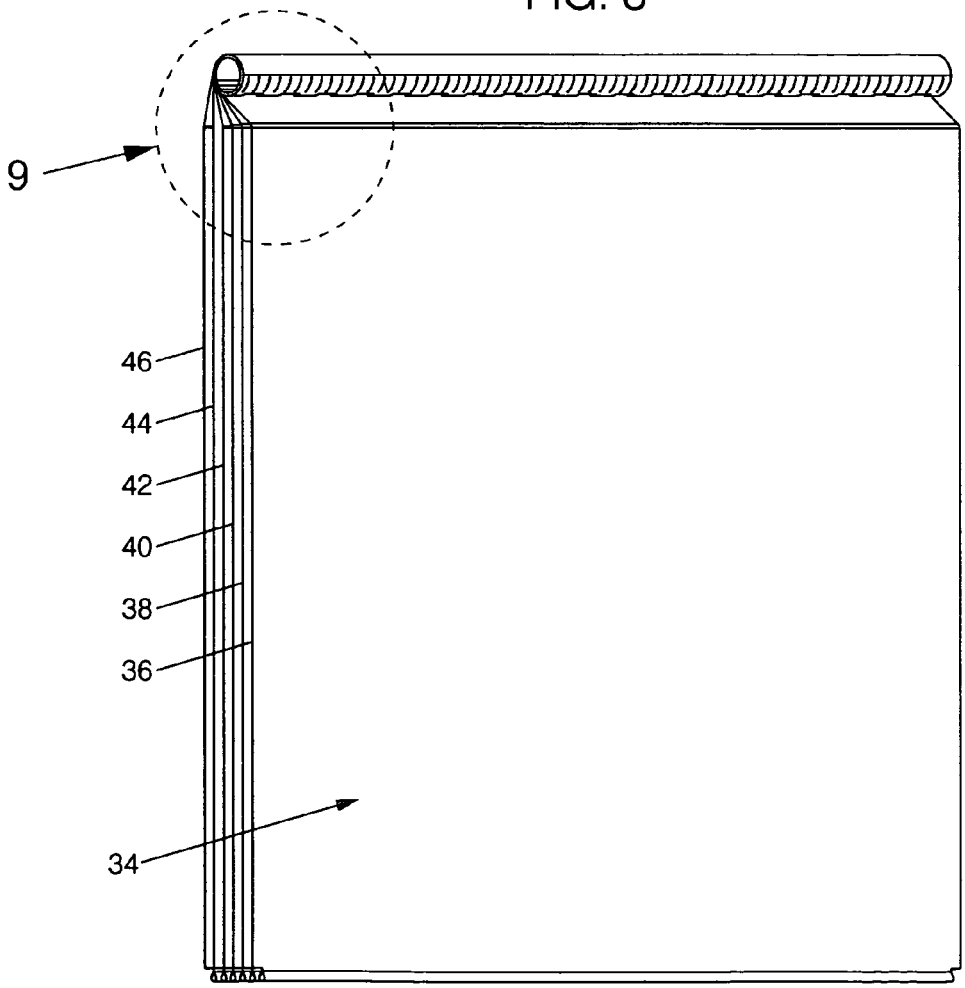

FIG. 14
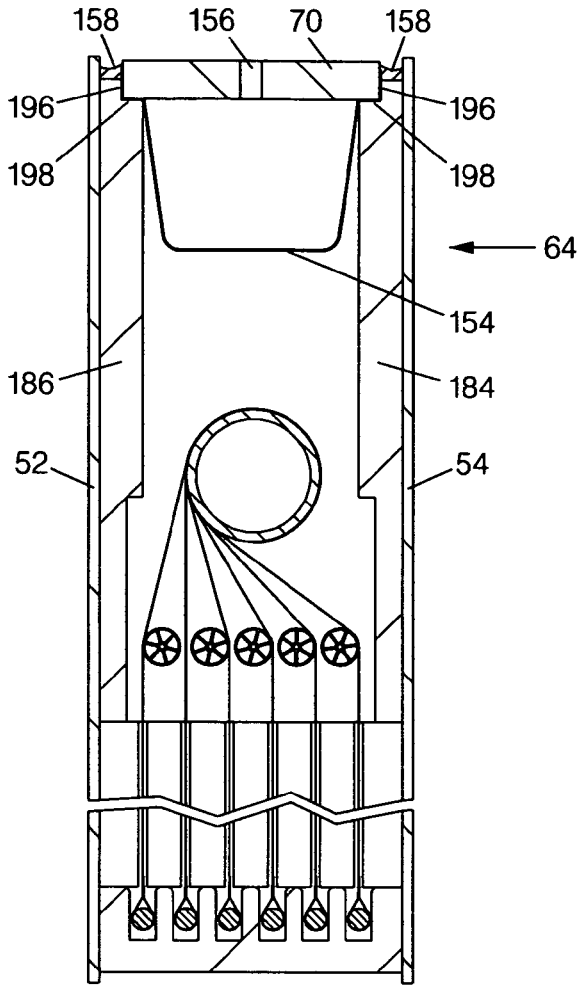
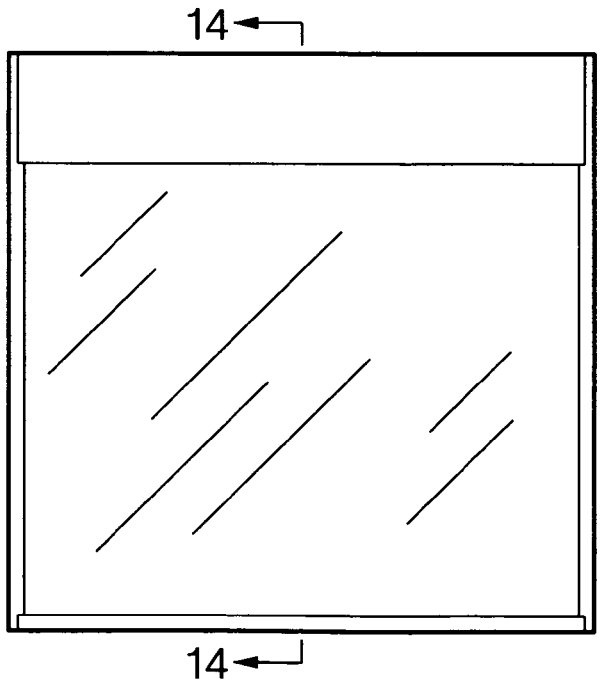
FIG. 13

MULTI-LAYERED FILM WINDOW SYSTEM

BACKGROUND OF THE INVENTION

The present invention relates to energy efficient windows and, in particular, to a sealed window having a plurality of suspended films and controls to extend and retract the films to control thermal efficiency.

Energy loss through glazed surfaces comprises a significant part of a building's total energy loss, and can typically approximate 50% of the total loss. These losses occur during the heating season as a consequence of a low insulating rating and outward heat flow, mitigated by the solar gain of any windows and walls exposed to the sun. During the cooling season, inward solar heat flow detracts from the insulating characteristic of the building walls and windows, unless shading is employed.

Attempts to improve the thermal transfer properties of glazed surfaces and particularly to decrease heat loss through glazed surfaces have in the past primarily consisted of shutters over the outer surface, for example, wooden "doors" from colonial times to modern motor-driven roll-up "slats". External covers suffer from an intrinsic R-value limitation on the order of 5 $hrft^2F/BTU$ per inch of thickness. The consequent rather bulky cover further precludes the application of such covers to curtain-wall structures, such as large buildings. It is also difficult to construct such covers to be weather tight, movable, and reliable.

Alternatively, curtains, shades, Venetian blinds, Roman shades, drapes and other interior window covers have been used to control thermal transmissions through windows. The effectiveness of internal covers is limited by a combination of factors including high infrared emissivity, air convection within the room spaces and leakage of air around and through window and wall surfaces.

A number of patents have issued that teach attempts to decrease air convection via improved sealing around the periphery of the frame of the window. All of these methods attempt to control heat and light flow by converting a "window" into a "wall". None of them, however, have produced structures yielding R-values approaching that of a frame wall. Some of these patents propose the use of metallized films or fabrics to decrease infrared emissivity to perhaps 0.3, but the structures suffer from problems of dust build-up and the necessity to frequently clean the surfaces and consequent vulnerability to damage.

A third approach to reducing energy losses through windows has been to use multiple glazing layers and/or to increase the spacing between the layers to perhaps 3 to 4-inches. In one such arrangement, reference U.S. Pat. No. 3,903,665, dry, insulation particles (e.g. foam beads or particles of other insulation materials) are moved through provided air passages via a vacuum or gravity between a storage space and the glazing air space. While this "bead-wall" approach has provided windows having reported R-values of the order of 20, several limitations exist. That is, the ducts or passages to and from these windows must be incorporated in the adjoining building structure or window framing. The beads occupy significant storage space when the windows are emptied. The glazing surfaces in contact with the beads tend to become covered with dust and statically suspended particles over time. The static electric charges can also rise to the point where high voltage discharges can result.

Yet another approach to attaining energy efficiency has been to use multiple layers of shading. For example, U.S. Pat. No. 4,187,896 shows a semitransparent curtain layer having a lowered infrared emissivity on an outer surface. The layer is suspended within the room space in the fashion of a shade and is mounted to a roller assembly. U.S. Pat. No. 4,039,019 describes the use of three or more mutually parallel, opaque shades. The shades can be attached to a retracting device and cover an internal building opening, such as a window. A number of resilient spacers separate the adjacent sheets and create several dead air spaces.

A variety of motor drives for shades are also found at U.S. Pat. No. 6,201,34, which discloses a digital microprocessor control with Hall Effect sensors used to sense limits. U.S. Pat. No. 6,082,443 uses a PLC to "learn" position limits for a motor equipped with a revolution counter. And U.S. Pat. No. 6,060,852 discloses a DC motor and battery mounted in a hollow tube.

The present invention improves upon the known art by providing a window assembly that provides a framework with two glazing layers and several intermediate planar films. The framework and films are arranged to obtain windows having R-values approaching that of framed walls. The films can also be raised and lowered via associated electro-mechanical assemblies to control relative ambient thermal conditions.

SUMMARY OF THE INVENTION

It is a primary object of the invention to provide an airtight, double-glazed window unit having more than one moveable film mounted in planar parallel relation to displaced glazing panels.

It is further object of the invention to provide a window unit filled with a desiccated air or a noble gas (e.g. Argon or Krypton).

It is further object of the invention to provide a window unit having a motorized roller assembly that manipulates multiple film layers mounted within the sealed enclosure.

It is further object of the invention to provide a motorized film drive assembly that can be fitted in a double glazed enclosure and which enclosure can be evacuated and back-filled with a desired gas.

It is further object of the invention to provide a film drive assembly that includes a primary film support roller and a number of secondary guide rollers and guide channels to support several films in parallel alignment.

It is further object of the invention to provide a primary film support roller wherein a drive motor linkage is contained in the hollow bore of the roller.

It is further object of the invention to provide optical control circuitry (e.g. infrared LED/phototransistor) to control the motorized roller drive in relation to sensed environmental parameters.

It is a further object of the invention to provide a plurality of metalized, coated or clear film layers, which layers can include indicia defining the travel limits of the films.

It is a further object of the invention to enable automatic control of the position of the films with the sensing of exterior and interior temperatures.

The foregoing objects, advantages and distinctions of the invention are obtained in a presently preferred, sealed window assembly. The window assembly incorporates several improvements over existing window wall systems that can also be incorporated into curtain-wall systems.

The present windows provide two high or variable transmission glazing layers that are separated by a spacing of the order of 3.5-inches. The glazing layers are sealed to grooved, frame pieces constructed from low thermal conductivity materials. The frame is capped with a motorized roller and film housing to define an airtight assembly. The assembly is purged and filled with a desiccated, inert dry gas, preferably an inert high molecular weight noble gas (e.g. Argon or Krypton).

Several partially or fully reflective, coated films are supported in planar parallel relation between the glazing layers from a motorized roller via several guide rollers and lateral guide tracks. The films are operable to move up and down in response to changing environmental conditions. The films define several non-convective dead air spaces, each on the order of ½-inch. A single motorized roller assembly collects the several films at the top of the housing in an "open" condition and lowers the films to completely block the glazed space in a "closed" or "wall" condition, wherein the window exhibits an R rating comparable to the imperforate framed wall.

The several individual films are attached to the motorized roller and suspended between guide rollers in several guide tracks with weighted rods or slats fitted to each film to maintain each film under tension. A variety of other devices can also be used to tension the films, which can be used for vertical or non-vertical applications and may comprise springs, cables, and electromechanical or electromagnetic devices. Airflow is restricted to limit convection between any two films with only a small temperature difference per space. The several dead air spaces provide a low thermal conductivity of still air with a low infrared coupling, assured by the reflective coatings, and collectively define a window capable of a R rating on the order of 18 to 20 $hrft^2F/BTU$.

The individual films are preferably comprised of a mechanically strong and smooth plastic layer of the order of 0.001-inch to 0.005-inch in thickness. A plastic such as polyethylene terepthelate (e.g. MYLAR®) is one type of acceptable material. Both surfaces of each film are coated with a suitable material to provide a low-emissivity surface that is also high in solar reflectance. For example, a 1000-Angstrom "mirror" film of aluminum exhibits an emissivity below 0.035 and a solar reflectance above 0.85. Other materials such as gold or copper, etc. might be coated on each film. The surfaces may also be coated with non-metallic materials or mixtures of metallic and non-metallic materials. The opaque reflective coatings reduce visible light transmission and protect the carrier film from ultraviolet degradation. The coating materials may be applied over a variety of surface preparations, for example a matte finish will limit specular reflectance. The films can also be imprinted or embossed to provide decorative effects.

The roller assembly should incorporate controls, e.g. limit switches, to predetermine the stop points for the motor, such as fully extended, fully retracted and intermediate film positions. Indicia at the film can define the control points for roller movement. The roller assembly presently is packaged in a top-mounted enclosure containing the motor, electronics, films, and limit switch sensors.

A control system for one or more windows along a single wall or specified walls of a defined space can be as simple as a wall-mounted switch calling for "window" or "wall" conditions. A control system might also permit manual control of desired roller assemblies to desired film travel positions, depending upon sensed thermal and solar conditions.

Another control system option is to provide occupancy sensors to control film movement to desired positions, depending upon room occupancy. Another option is to provide a control system that promotes solar heating during the heating season and reduces solar gain during the cooling season. Such a control system monitors differential between indoor room air temperature and instantaneous solar heating potential. Solar heating potential is measured by a temperature sensor mounted to a suitably constructed and oriented solar absorber.

Still other objects, advantages, distinctions and constructions of the invention will become more apparent from the following description with respect to the appended drawings. Similar components and assemblies are referred to in the various drawings with similar alphanumeric reference characters. The description should not be literally construed in limitation of the invention to the presently preferred construction or any suggested improvements or modifications. Rather, the invention should be interpreted within the broad scope of the further appended claims.

BRIEF DESCRIPTION OF THE DRAWINGS

FIG. 8 is a perspective view of the film subassembly.

FIG. 9 is an enlarged view of detail 9 on FIG. 8.

FIG. 13 is a front view of a window showing the films in a fully closed condition.

FIG. 14 is a foreshortened vertical cross section view taken along section lines 14—14 of FIG. 13.

DESCRIPTION OF THE PREFERRED EMBODIMENT

Figure 1:
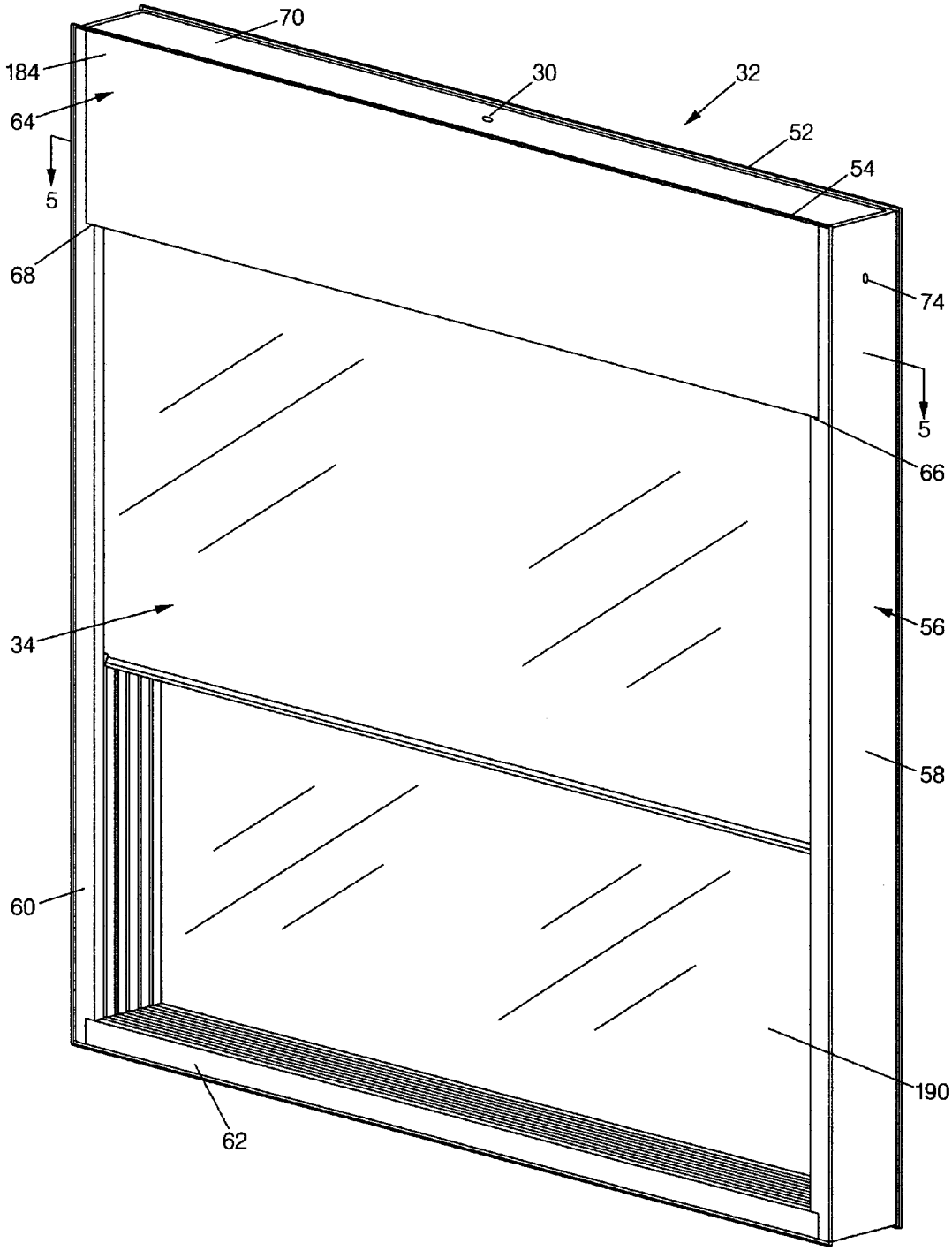
FIG. 1 is a perspective drawing of a window that includes the improvements of the invention and shows the films in a 40% open position.

As generally noted above, the invention seeks to provide a sealed, glazed window assembly 32 having two layers of glass 52 and 54 or other suitably transparent material separated by several intermediate film layers 36–46. The assembly 32 is designed to demonstrate an insulation R-value on the order of a frame wall (e.g. R18 to R20). In contrast, a typical frame wall R-value of 19 is achieved with fiberglass bats fitted in a 6" solid, opaque framed wall.

The significance of the capabilities of the assembly 32 can be appreciated upon consideration of the applicable physics relating to multi-layered glazed assemblies and available multi-layered windows. The physics of the assembly 32 derives from basic considerations that glass is transparent in the visible spectrum and a layer of glazing transmits approximately 95% of incident sunlight. A single layer of glass, which has a through-glass resistance of about 0.02 $hrft^2F/BTU$ has a measured R-value of about 1.0 $hrft^2F/BTU$. This is the sum of the coupling of the room air to the interior glazing surface plus the outside air to the outer glazing surface, depending on wind and draft-induced reductions.

Two layers of glass might thus be expected to exhibit an R-value of approximately 2.0, plus the additional R-value of the intervening air. Still air is a relatively good thermal insulator and is used in some windows to separate glazing layers. The thermal conductance of still air is tabulated as being about 0.177 $BTU/hrft^2F/in$, which might be expected to increase the R-value by more than 5 per inch of spacing. Convection, however, usually limits this insulative value.

Glass, however, is quite absorptive of long wavelength or infrared energy and exhibits an emissivity and absorptivity of about 0.84. This characteristic further limits the effectiveness of any air spacing provided between adjacent glazing layers to enhance R-value. This is due to the infrared coupling that occurs between the glazing layers.

The thermal resistance, R, of several layers in series must include the parallel terms for conductance or U-value, where R=1/U. The radiative heat transfer between two surfaces is given by Boltzmann's equation. For two surfaces have differing emissivities and differing temperatures, the U-value depends on the difference in temperatures of the two surfaces in a non-linear fashion. For an exemplary surface i having an infrared emissivity $\epsilon_i$ facing a second surface j having an infrared emissivity $\epsilon_j$ at two absolute temperatures $T_i$ and $T_j$ (i.e. in degrees Rankine or in degrees Fahrenheit+459), the net radiative heat transfer between the two surfaces is:

$$Q_{ij}=\sigma\times\epsilon_{ij}\times[T_i^4-T_j^4],\text{ where }\epsilon_{ij}=1/[1/\epsilon_i+1/\epsilon_j-1]\text{ and }\sigma=1.712\times10^{-9}\ BTU/hrft^2F^4.$$

Stated differently, assuming a mean annual temperature gradient of 75° F. across a one square foot window (i.e. approximately equal summer and winter temperature extremes) and selecting 1) a temperature $T_i$ of 110° F. (i.e. 569° R) and a temperature $T_j$ of 40° F. (i.e 499°R) and 2) using the emissivity for glass as 0.84, provides a U-value of 0.758 and a commensurate R-value for the exemplary thermal radiation path of only 1.32. Thus, it is clear that the total R-value of a double glazed window must be less than 2.32, which is the sum of the 1.0 of the external surfaces plus 1.32. This value is further reduced by the heat flow by convection and conduction between the two glass surfaces.

The R-value of a double-glazed, air-filled window has been physically shown to reach a maximum value of approximately 2.0 $hrft^2F/BTU$ at a spacing of about ½" to ⅝" as demonstrated by measurements reported by K. R. Solvason and A. G. Wilson of the National Research Council of Canada, in CBD-46, Factory-Sealed Double-Glazing, where two different outer air temperatures and two different outer air velocities were used. This is a consequence of the convective heat transfer of the air mass between the glazing layers increasing with increasing separation, thus limiting the attainable R-value for a larger spacing.

Even ignoring the losses of the window framing, the best multi-layered windows promise about 6.0 $hrft^2F/BTU$. These "best" windows are triple-glazed and provide an air spacing on the order of ½", with semitransparent coatings at the glazing to decrease the infrared emissivity to about 0.35. They also replace the dry air with argon, which decreases the thermal conductance by about 15% since this noble gas has a higher molecular weight than air.

In lieu of using multiple glazing layers, the invention uses several layers of metallized plastic film between the two glazing panels. Those two glazing panels may be tinted and/or colored to retain a clear view without glare when "open". To "close" the view and create a "wall", these internal films will typically be opaque in the visible spectrum. For example, films of polyethylene terepthelate (such as Dupont Mylar) can be coated on both surfaces with vacuum-deposited aluminum to exhibit an infrared emissivity below 0.035. The layer-to-layer conductance of radiation or U-value between two such films will be approximately 0.019 $BTU/hrft^2F$, which is a decrease of 40:1 to that between displaced glass panels. An offsetting, debilitating characteristic of such films, however, is that their properties degrade when exposed in air to dust and humidity. The invention seals these films within the glazed enclosure thus insuring stable performance.

The invention significantly reduces conductive thermal transfer by using several such films to subdivide the total space between the two outer glazing panels. Air has a high R-value and provides good insulation, as long as it remains still. An insulated glazing unit (IGU) with one side warmer than the other develops an internal convective circulation. This circulation transfers heat from the warm side to the cold side. Larger warm side/cold side temperature differences (ΔT), result in greater heat transfer. The net result is significant heat loss in winter and heat gain in summer.

This invention's use of multiple films to subdivide the space between the two glazing layers greatly reduces the convective circulation and heat transfer. For example, a six-film, seven-space window system operating with an indoor/outdoor ΔT of 70° F. yields a space-to-space ΔT of 10° F. This reduced ΔT reduces the convection current's circulation speed resulting in reduced heat transfer. For example, a standard, dual-glazed, single-space, IGU operating with an indoor/outdoor ΔT of 70° F. transfers heat a rate of 31.15 BTU/ft2/hour. The aforementioned six-film, seven-space window system reduces this heat transfer to 3.5 BTU/ft2/hour, a reduction of 27.65 BTU/ft2/hour or 89%.

The efficacy of the foregoing film-based window system window with R-values approaching framed walls was assessed theoretically and experimentally. Detailed calculations were performed to predict the expected R-value if two glass panels were separated by 3.5" with six films of aluminized Mylar$^R$ at ½" spacings. The two glazing panels were presumed to be coupled, via R=0.5 on each face, to air temperatures of 110F and 40F. Tabulated values were used for the thermal conductivity of still air as a function of temperature and for ⅛-inch thick glass panels. The infrared emissivity was taken as 0.84 for glass and as 0.035 for vacuum-deposited aluminum. This analysis determined that the maximum temperature difference between any two of the seven ½" airspaces was 10.5° F., and in the complete absence of convection, provided a highly efficient total R-value of 19.35 $ft^2hrF/BTU$ for the window.

The calculated R-value was also confirmed with an experimental apparatus prepared to make direct measurements of heat transfer through a "test window" having up to six aluminized Mylar$^R$ films spaced between two glass layers. The glass layers were 39.75" square and spaced apart 3.75-inches. The individual films were selectively supported between the glazing panels on "frames" of ½" thick Owens-Corning FOAMULAR® thus leaving an open area of 36 square inches. A "cold" chamber and a "hot" chamber were provided on opposite sides of the glazing panels. A "guard" chamber also separated the hot chamber from the ambient. The guard chamber could be brought to the same temperature as the hot chamber. The chambers were segregated with walls of 6" FOAMULAR®. Each chamber was provided with a circulating fan. The "cold room" was filled with ice behind an aluminum plate painted for high emissivity and thus held around 32 F. The "hot room" was brought to about 110 F by use of a measured and controlled electric heater, again behind a second painted aluminum plate. The "guard room" had a second electric heater. The "window" being measured was thus at a mean temperature of 75° F., with both faces swept by fan-driven air.

The spacers were covered one by one with layers of 0.002-inch aluminized Mylar® with all remaining spacers being used to fill in the total 3.75-inch space opening between the two "rooms". Measurements were made starting with 0 layers (just one air space of ½") until a total of six aluminized layers were added. The measured, experimental results are set forth in TABLE I below:

TABLE I

EXPERIMENTAL MEASUREMENTS

| Number of Films | Glass-to-Glass Spacing, inches | R, $ft^2hrF/BTU$ |
|---|---|---|
| 0 | 0.5 | 1.60 |
| 1 | 1.0 | 4.29 |
| 2 | 1.5 | 6.19 |
| 3 | 2.0 | 8.23 |
| 4 | 2.5 | 9.49 |
| 5 | 3.0 | 10.54 |
| 6 | 3.5 | 17.95 |

In a separate measurement intended to validate the calibration of the measurement apparatus, one measurement was made with the entire 39.75" square filled with seven ½" thick layers of FOAMULAR®. This "wall" would be expected to have an R-value of about 18.5, with 3.5" of R-5 per inch foam plus the air spaces on the outside of the glazings contributing about the 1.0 of a single glass. The result of this measurement was R=18.16 $ft^2hrF/BTU$.

The measured value of 17.95 is quite close to the value for FOAMULAR®, both as measured and as expected from its rating. Replacing desiccated air with argon is expected to yield R-values exceeding 20. The agreement between the theoretic prediction and the measurement in a calibrated system was felt to verify that such spacers could indeed turn "a window into a wall". The particular advantage, however, is that the present "wall" can also turn into a "window", upon rolling the several metallized films onto a "roller" mounted within the enclosed window space.

WINDOW ASSEMBLY CONSTRUCTION

Figure 2:
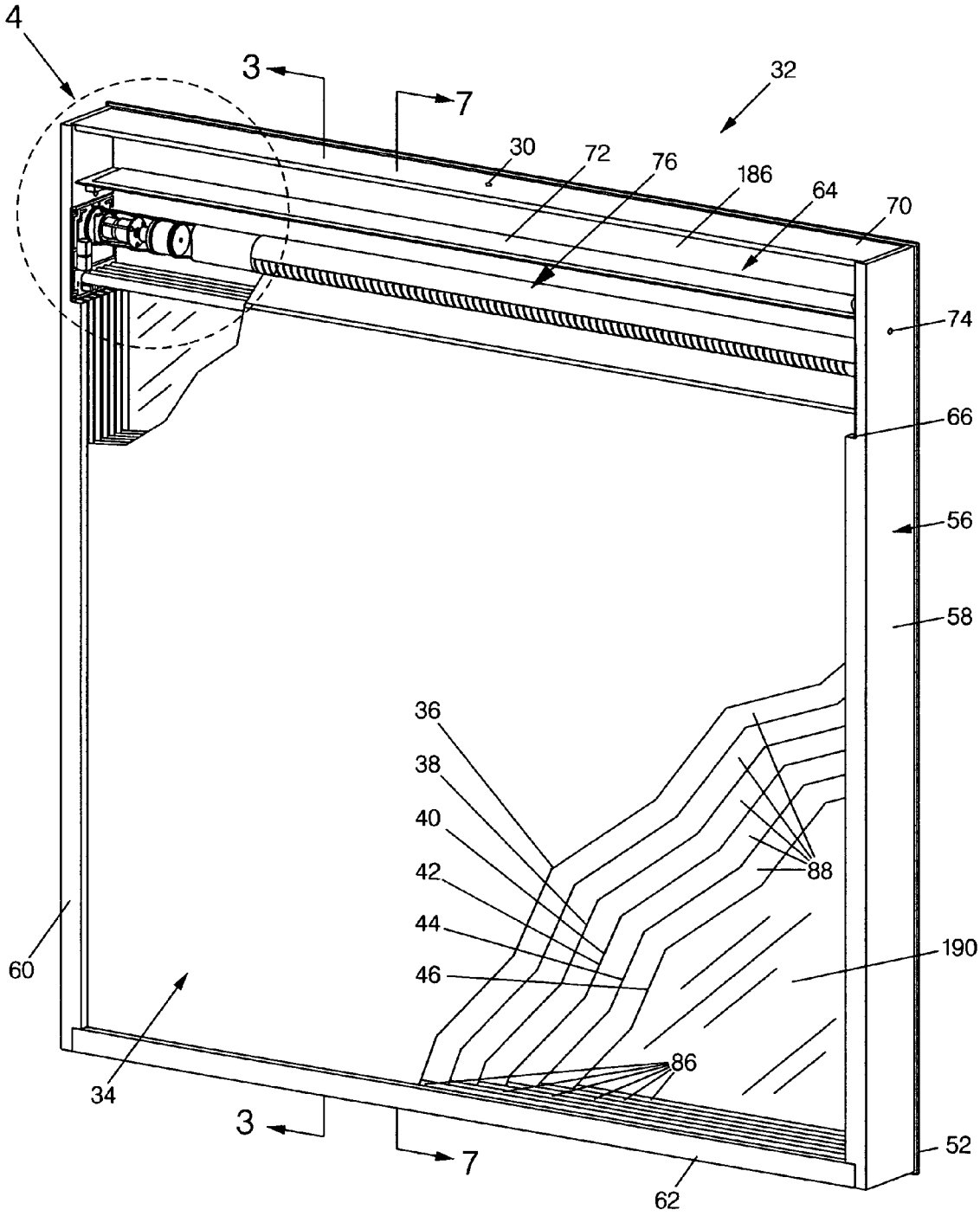
FIG. 2 is a perspective drawing of a window showing the roller assembly exposed and wherein the displaced parallel films are shown in cut section.

Referring to FIGS. 1 and 2, perspective drawings are shown to the construction of a presently preferred window assembly 32. The window 32 is constructed to exhibit an R-value comparable to a nominal 6-inch framed wall. The window 32 is particularly capable of exhibiting an R rating in the range of R18 to R20 with the aid of several layers of displaced parallel films 36, 38, 40, 42, 44, 46, shown in the various views of FIGS. 1–14. The film layers 36–46 are spaced apart-predetermined distances between interior and exterior glazing pieces 52 and 54 (e.g. panes of glass or other relatively rigid transparent or translucent materials).

The glazing pieces 52 and 54 are typically clear glass, but other materials can be used and the material may be tinted, coated, or treated to provide variable light transmission in order to promote viewing without glare or overheating. The glazing pieces 52 and 54 are attached to a rigid framework 56 in a fashion to provide an airtight or hermetic seal with the framework 56. The glazing pieces 52 and 54 should be mounted to minimize undesired thermal transfer and can be secured using appropriate adhesive materials and/or routings in the frame 56. The numbers, mounting and types of film layers 36–46 and/or combinations of film and glazing layers can be varied as desired and as described in greater detail below. The particular advantage of the improved window assembly 32 is that the assembly 32 provides solar illumination with minimal thermal energy transfer losses throughout the year.

The framework 56 of the window 32 is constructed of left and right vertical or longitudinal sash pieces 58 and 60, a horizontal or transverse, bottom sash piece 62 and a horizontal or transverse, top sash piece 70. The sash pieces 58, 60, 62 and 70 should be assembled to minimize the thermal flow around the interior periphery. The sash pieces 58, 60, 62 and 70 can be constructed from wood, plastic, foam (e.g. urethane foam), metal or a variety of composite or covered materials that have a relatively low thermal conductivity. The materials should exhibit a long-term stability to ultraviolet light etc., maintain impermeability to gas and water transmission, and generally be compatible with the anticipated application and environment. Structural foams extruded to have nonporous skins on exposed surfaces are well suited for this application.

A separately formed and assembled multi-film roller housing 64 is fit to notched recesses 66 and 68 let into the upper ends of the sash pieces 58 and 60. The housing 64 can however be mounted at any desired sash location, including adjacent the bottom sash piece 62. The housing 64 is secured to the sash pieces 58 and 60 with suitable fasteners and/or adhesives. The transverse cap piece 70 encases the framework 56 and housing 64. Front and rear walls 184 and 186 of the housing 64 span between and interlock with the longitudinal sash pieces 58 and 60. The width of the transverse sash pieces 62 and 70 defines the space between the glazing pieces 52 and 54, which is a nominal 3½-inches for the presently preferred assembly 32.

Appreciating that the framework 56, glazing pieces 52 and 54 and roller housing 64 are constructed and fitted to be hermetically sealed, the window assembly 32 must be constructed to withstand the pressure differences that develop with changing temperatures and altitudes. For example, a window unit of the same height and width as the window assembly 32, but with an airspace of only ½", and sealed with the internal gas temperature at 70° F., would develop an internal pressure on the order of 0.7 psi or 100 pounds per square foot when exposed to an exterior temperature of 120° F. and an interior temperature of 70° F. If this pressure difference were maintained, the glass would flex outward approximately ¼ inch. However, an average increase in separation of 0.024" would remove the excess pressure. The window 32, in contrast provides a nominal airspace of 3½" between the glazing pieces 52 and 54. When exposed to the same temperature conditions, the assembly 32 can experience a significantly greater flexing of the glazing surfaces.

The use of flexible seals and adhesives to secure the glazing pieces 52 and 54 to the frame 56 can accommodate some pressure equalization. Thicker glass can also provide greater resistance to flexing. Alternatively, an expandable membrane or other device that produces an expandable volume can be fitted to the window assembly 32 to provide pressure relief without releasing the inert fill gas or allowing the ingress of moisture. Such an expansible device will also provide pressure relief during high altitude shipping.

An example of one type of volume expansion or pressure equalization device is shown in FIGS. 2, 3, 4, and 7 and comprises an elastomeric membrane 72. A variety of flexible plastic and film materials can be used to construct the membrane 72. The membrane is directly secured to ledges 188 formed in the front and rear walls 184 and 186 of the housing 64 and the lateral sash pieces 58 and 60. Alternatively, the membrane 72 can be mounted to a rigid planar support piece and over one or more apertures that extend through the support piece. The support piece can then be sealed to the ledges 188 and/or channels in the front and rear panels 184 and 186 and sash pieces 58 and 60. The membrane 72 is hermetically sealed to the walls 184 and 186 and sash pieces 58 and 60 and provides a primary seal for a lower lying film roller assembly 76 and films 36–46.

The membrane 72 forms the upper surface of the hermetically enclosed space 190 that contains the films 36–46. Pressure changes inside the interior space 190 causes the elastomeric membrane 72 to passively deflect inward or outward to compensate and reduce the pressure exerted on the glazing pieces 52 and 54. A vent port 30 through the top sash piece 70 allows air to migrate between the ambient environment and the interior space above the membrane 72.

After first being purged of all air, a desiccated, inert dry gas, preferably an inert high molecular weight noble gas (e.g. Argon or Krypton), is inserted into the airspace 190 via a suitable, hermetically sealable, purge-and-fill port 74 to enhance the thermal efficiency of the window 32. Multiple ports 74 might be provided through the frame pieces 58–60, 70 and seal 72 to assure a suitably airtight assembly 64 and permit the routing of necessary control wiring.

Figure 16:
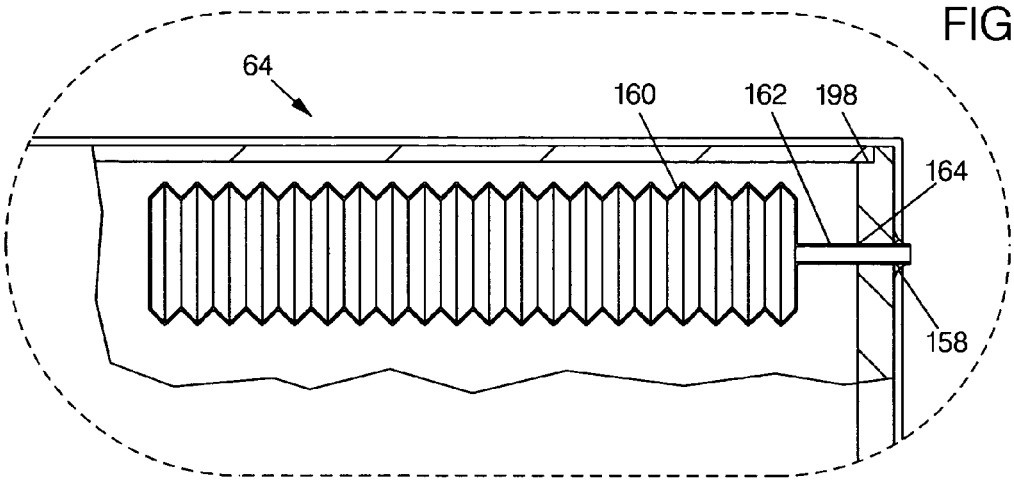
FIG. 16 is an enlarged view of detail 16 on FIG. 15.
Figure 15:
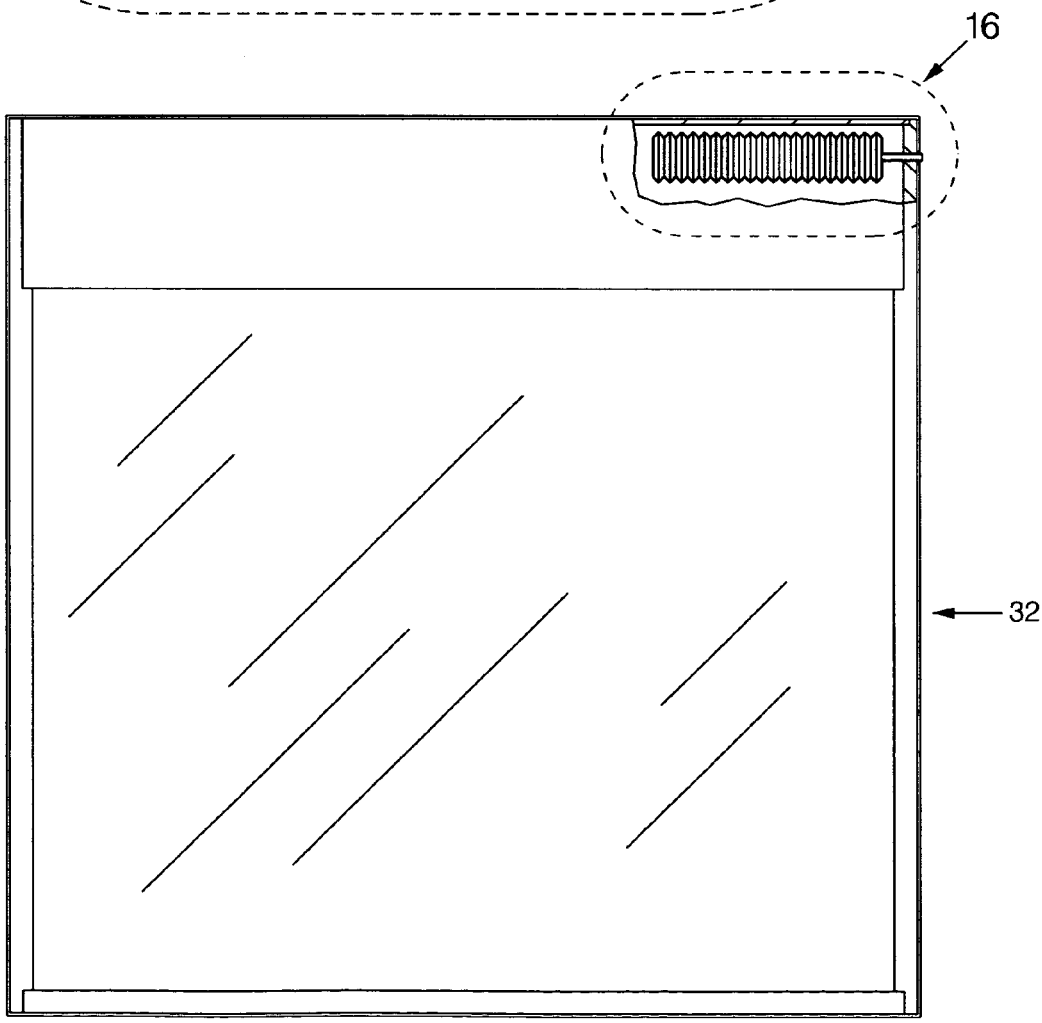
FIG. 15 is a front cutaway view of a window showing the films in the closed condition.
Figure 20:
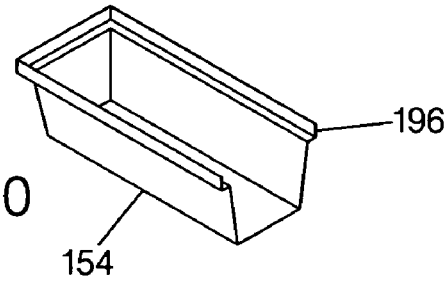
FIG. 20 is a perspective vertical cross section view taken along section lines 20—20 through FIG. 19.
Figure 19:
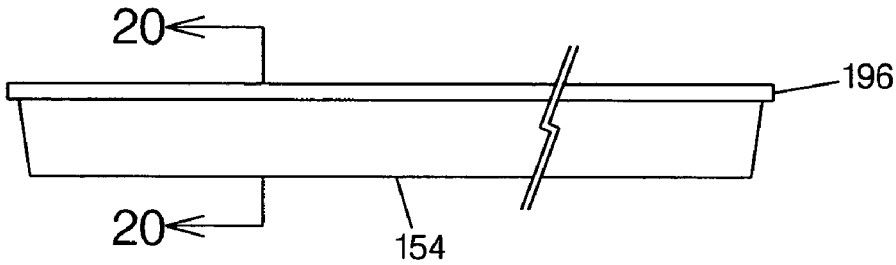
FIG. 19 is a foreshortened front view of an alternate pressure relief membrane assembly.
Figure 18:
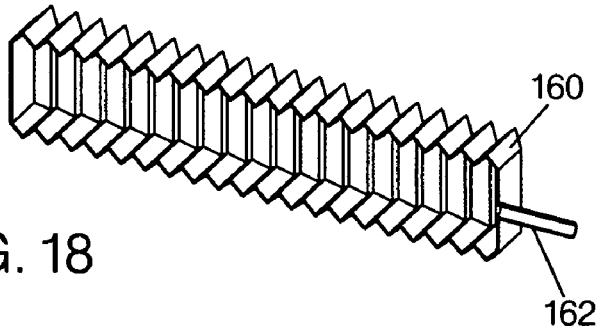
FIG. 18 is a perspective vertical cross section view taken along section lines 18—18 through FIG. 17.
Figure 17:
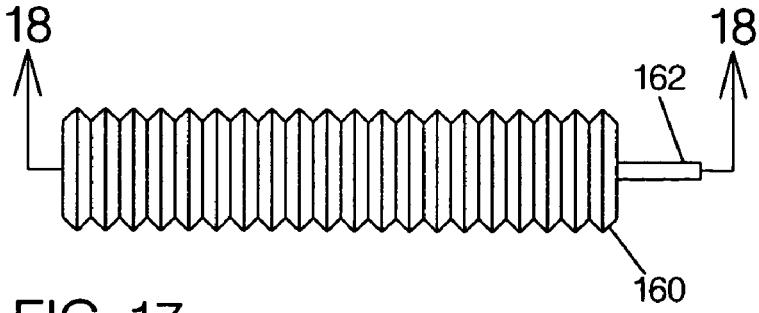
FIG. 17 is a top view of an alternate pressure relief bellows.

Examples of two other possible pressure relief devices are shown in FIGS. 14, 15, and 16. FIG. 14 shows a sectional view of a U-shaped membrane 154 constructed to create a hermetic seal in cooperation with the top sash piece 70. Flanges 196 at the edges of the membrane 154 overlap flanges 198 in the panels 184 and 186 and sash pieces 58 and 60. Conventional IGU assembly techniques include application of sealant 158 to the perimeter of the top sash piece 70 that defines the space between the glazing panels 52 and 54. The shape of the membrane flanges 196 allows perimeter sealant 158 to encapsulate the edges 198 and provide a positive hermetic seal.

FIG. 16 shows a flexible accordion-shaped bellows 160 that can be used in lieu of the membranes 72 or 154. The bellows 160 is constructed of a suitable long-lived flexible material (e.g. plastic or polymer or coated material, rubber etc.). A vent tube 162 is attached and hermetically sealed to the bellows 160. The bellows 160 is mounted inside the housing 64. The vent tube 162 penetrates sash piece 58 at a hole 164. Application of conventional IGU sealant 158 around tube 162 at the hole 164 completes the hermetic seal. Pressure increases inside the sealed widow system exert pressure on the outside of bellows 160 causing it to compress, forcing air out of vent tube 162. Pressure decreases inside the interior space 190 causes the bellows 160 to expand, allowing air to flow into bellows 160 through tube 162.

In many cases, particularly when multiple windows are arrayed around an entire floor of a curtain-wall building, it may be preferred to connect all windows via interconnected runs of tubing or conduit to a centralized pressure-equalization source. This source could consist of a bi-directional pump/compressor unit capable of transferring fill gas to-and-from a pressure vessel. This function would be under the control of appropriate pressure sensors. The sensors would control the pump/compressor unit in order to maintain a slightly positive pressure inside the windows by adding or removing fill gas. The sensor could also provide appropriate alerts, for example, fill gas leakage and/or notify a security system of rapid loss of gas pressure as from a broken window.

Figure 3:
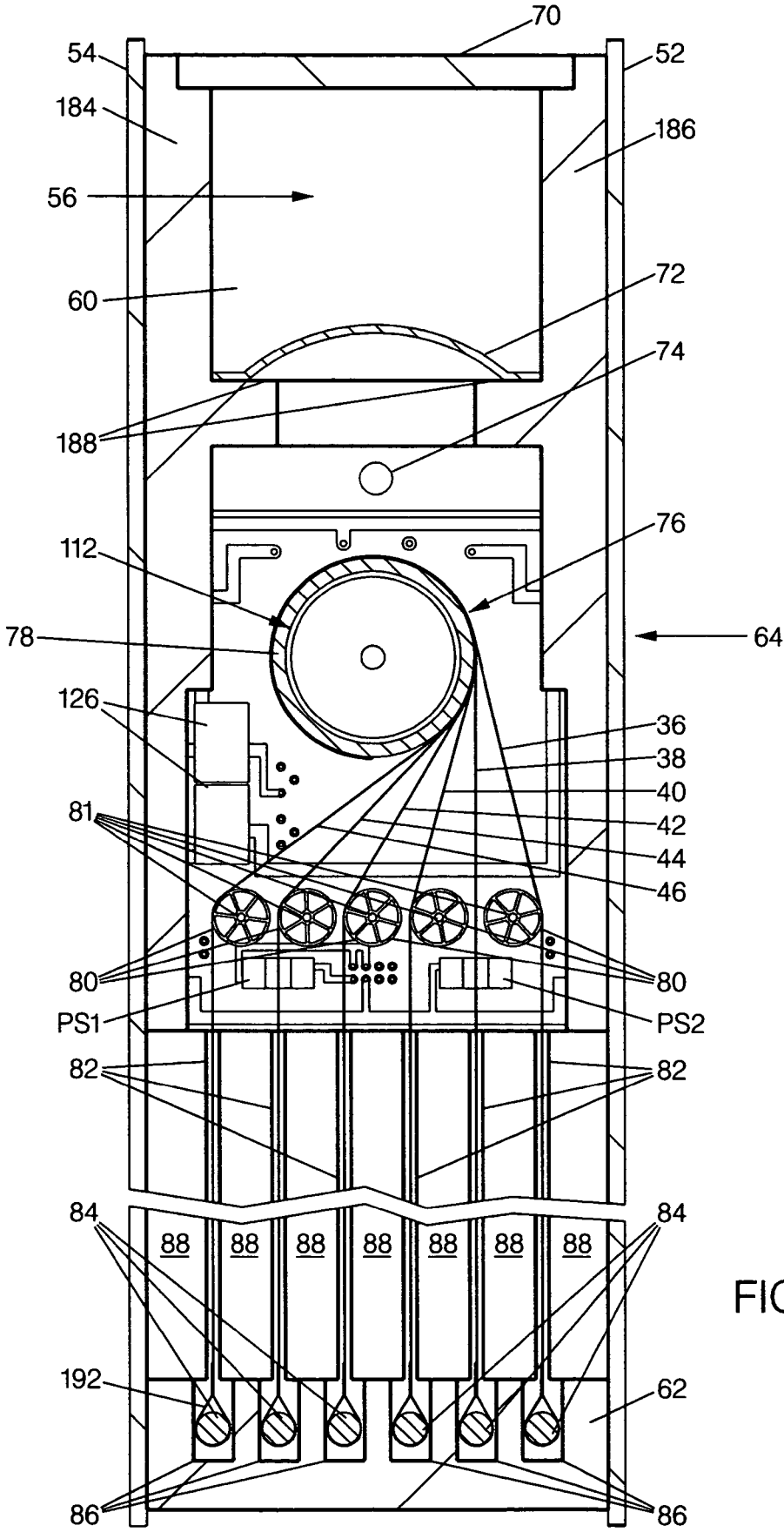
FIG. 3 is a foreshortened vertical cross section view taken along section lines 3—3 of FIG. 2.

With additional attention to FIG. 3, the films 36–46 are mounted to the roller assembly 76 and are operable to extend and retract in displaced parallel alignment to one another. FIG. 3 shows a detailed sectional view through the active motorized end of the roller assembly 76 adjacent the sash piece 60 and a detailed sectional view through the bottom of the window assembly 32.

The films 36–46 are supported to a hollow, primary roller 78 and are individually directed over secondary rollers 80. The secondary rollers 80 are supported from axles 81 at the sash pieces 58 and 60. The lateral edges of the films 36–46 are confined to vertical channels 82 let into the interior surfaces of the sash pieces 58 and 60. The films 36–46 are held taut with weights 84 slid into pockets 192 at the bottom edge of each of the films 36–46. This method of mounting the weights 84 prevents wrinkling of the film surfaces from differential thermal expansion between weights 84 and the films 36–46. The weights 84 can also be bonded to the films 36–46 and/or can be attached at any desired location on the films 36–46. Other film tensioning means may also be used, for example, spring-assisted assemblies or flexible stays mounted to the films 36–46.

The weights 84 nest within grooves 86 let into the bottom sash piece 62. The nominal spacing between the films 36–46 is ½ inch as defined by the centerline spacing of the channels 82 and grooves 86; other spacings can be provided and might typically be constructed in a range from ⅜ to 1 inch. When fully extended, the films 36–46 create a number of dead air spaces 88 between the adjacent film and glazing layers 52 and 54.

The films 36–46 are preferably constructed of a mechanically strong and smooth plastic layer on the order of 0.001" to 0.005" in thickness. A plastic such as polyethylene terepthelate (e.g. MYLAR®) is one type of acceptable material. Both surfaces of each film 36–46 are metalized to provide a low-emissivity surface that is also high in solar reflectance. For example, a 1000-Angstrom "mirror" film of aluminum exhibits an emissivity below 0.035 and a solar reflectance above 0.85. Such a "mirror" film is opaque and also protects the plastic substrate or carrier film from ultraviolet degradation. The exterior facing surfaces may be metalized over a matte finish to limit specular reflectance. The films 36–46 can also be imprinted or embossed to provide decorative effects.

It is recommended that the roller assembly 76 for a given window be packaged within a generally rectangular insulated housing 64 that is sized to span the top several inches of a desired double-glazed window unit 32. The housing 64 can include standard configurations of packaged electronics describe below, including gearing, motor and limit sensors at one driving end of the roller assembly 76. Upon tailoring the length of the roller assembly 76 and attaching an appropriate number of metalized films of appropriate width and length, windows of various width and height dimensions can be readily assembled.

With yet further attention to FIGS. 8–12, the films 36–46 can be secured to the roller 78 in various fashions. Of particular concern is to compensate for any mismatch in the thermal expansion rates of the roller and/or film materials, which can induce wrinkling or puckering of the films 36–46 during temperature extremes. This type of distortion would effect the thermal efficiency of the assembly 32, be visually objectionable, and could interfere with the raising and lowering of the films 36–46. Described below are two possible methods to prevent this from occurring.

Figure 11:
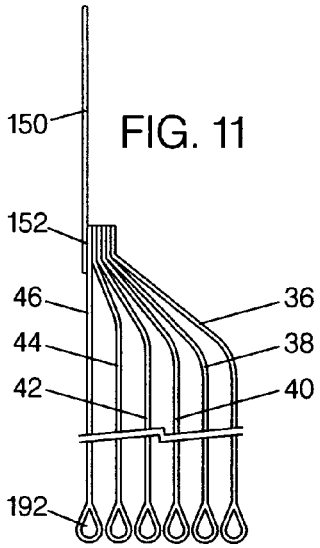
FIG. 11 is an enlarged view of detail 11 on FIG. 10.
Figure 12:
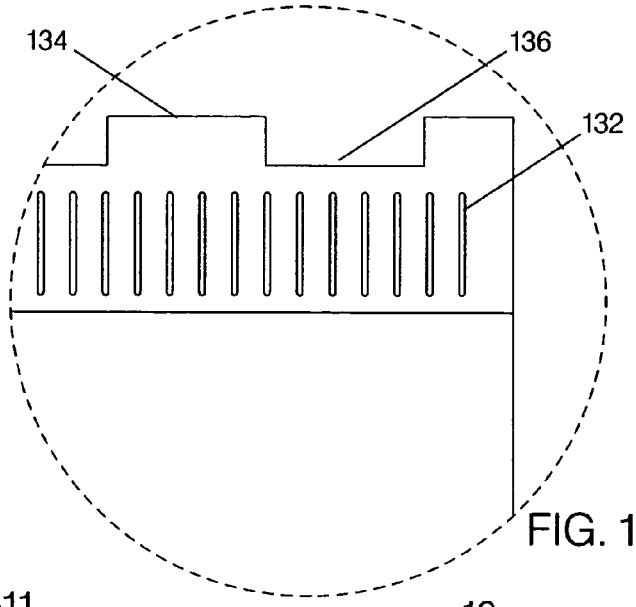
FIG. 12 is an enlarged view of detail 12 on FIG. 10.
Figure 10:
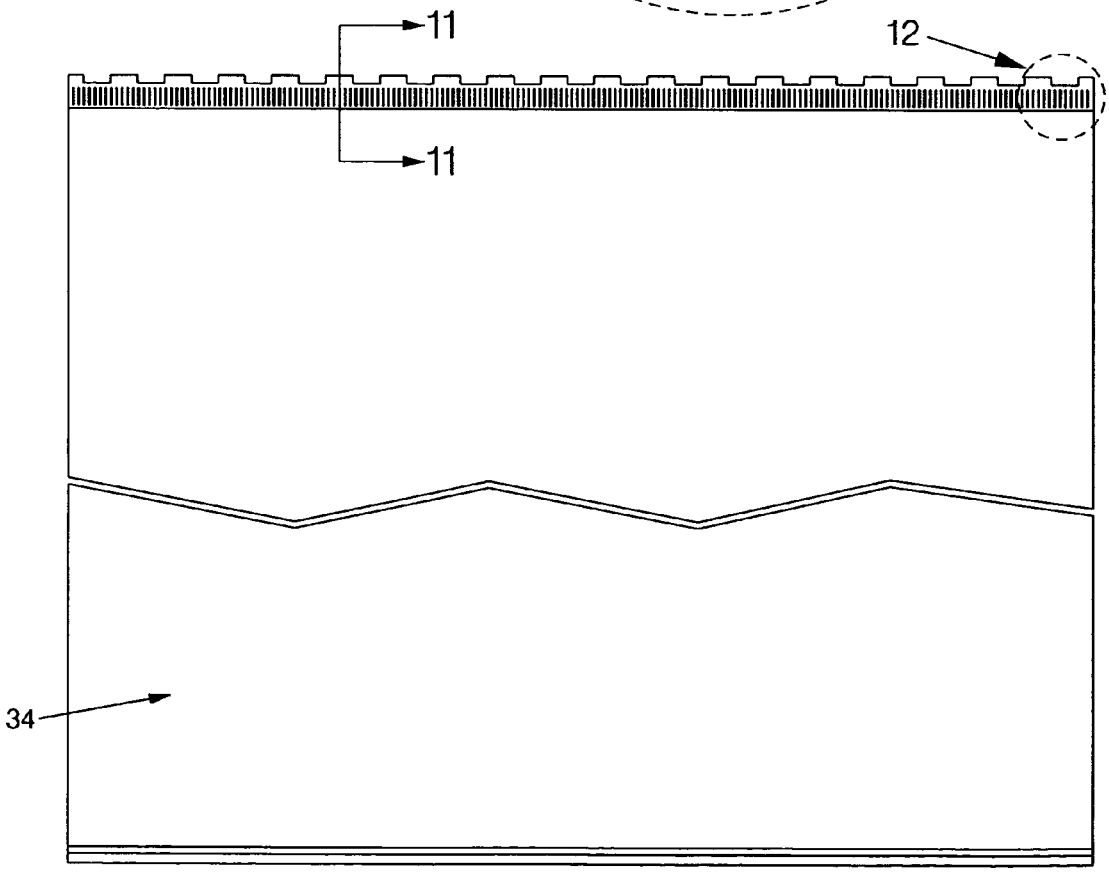
FIG. 10 is a foreshortened front view of the film subassembly.

The first method is shown in FIGS. 8, 9, 10, 11, and 12. In this method, the films 36–46 are fastened together using mechanical, adhesive, or thermal methods. As shown in FIG. 11, the films 36–46 can be bonded to a separate attachment piece 150 that extends beyond the top edge of the films 36–46. Alternatively, one film can extend beyond the top edge of the remaining films.

The extended film or separate attachment piece 150 is secured to the roller 78 at tabs 134 with mechanical fasteners, adhesive, or a thermal bonding. The tabs 134 and intermediate notches 136 between the tabs 134 provide relief from thermally induced, differential movement along the line of the several attachment points of the tabs 134 to the roller 78, thereby preventing localized wrinkling.

The forming of closely spaced slots 132 into the extended film or separate piece 150 also creates expansion joints in the attachment film to take up movement resulting from thermal expansion or contraction of the roller 78. The slots 132 particularly create multiple strips that are each able to flex laterally. The slots 132 and notches 136 thus prevent forces resulting from thermal expansion or contraction of the roller 78 and/or films 36–46 from being transferred into the body of the films 36–46 to cause distortion.

A second method of controlling distortion of the films is by matching the properties of the films and roller. For example, if the films are made from aluminized Mylar® the roller could be constructed from a tube made with Mylar®, or another material with similar properties. Matching the thermal expansion properties of the roller 78 and films 36–46 will eliminate the possibility of thermally induced distortion.

The roller 78 is constructed of a hollow tubular material having a circular cross section. The roller 78 can be constructed of a variety of materials (e.g. aluminum, stainless steel, or a reinforced composite material) suitable to the film type, mechanical strength, and anticipated thermal and UV conditions. The cross-sectional shape can also be varied so long as the roller 78 is able to collect and dispense the films 36–46 without inducing kinking, stretching or other deformities. The roller 78 might also be coated with a deformable material that accommodates thermal expansion.

Figure 4:
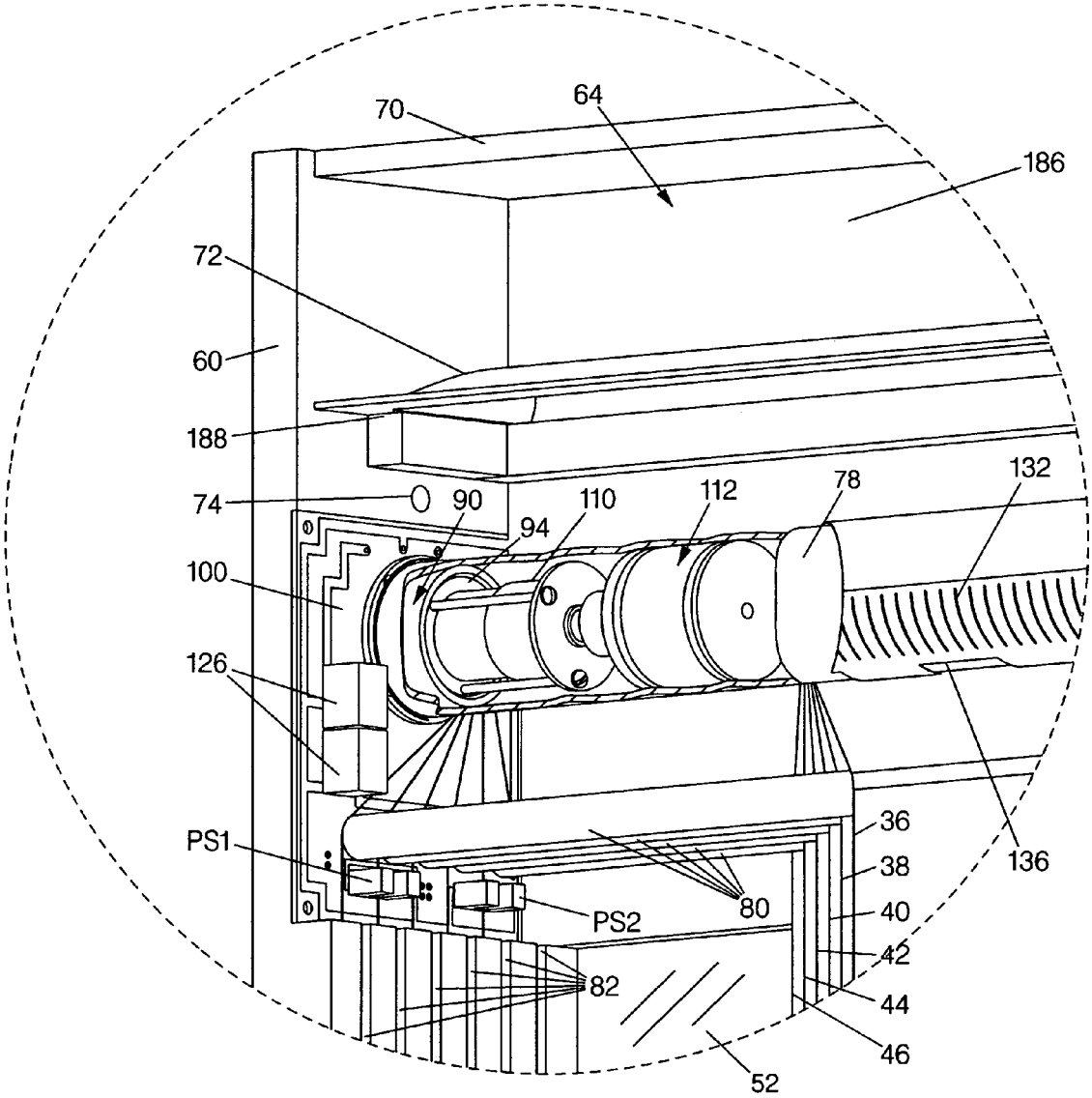
FIG. 4 is an enlarged view of detail 4 on FIG. 2
Figure 5:
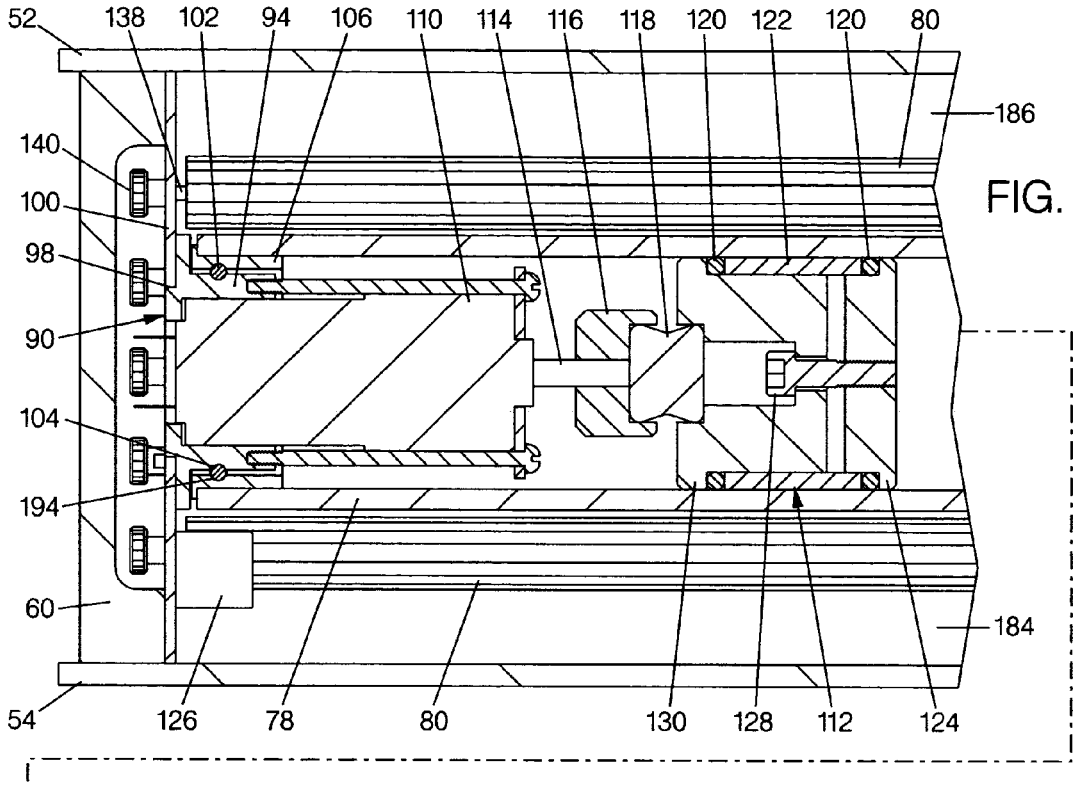
FIG. 5 is a foreshortened horizontal cross section view taken along section lines 5—5 and through the motorized end of the drive roller of FIG. 1. The dashed line indicates the relative orientation between FIGS. 5 and 6.
Figure 6:
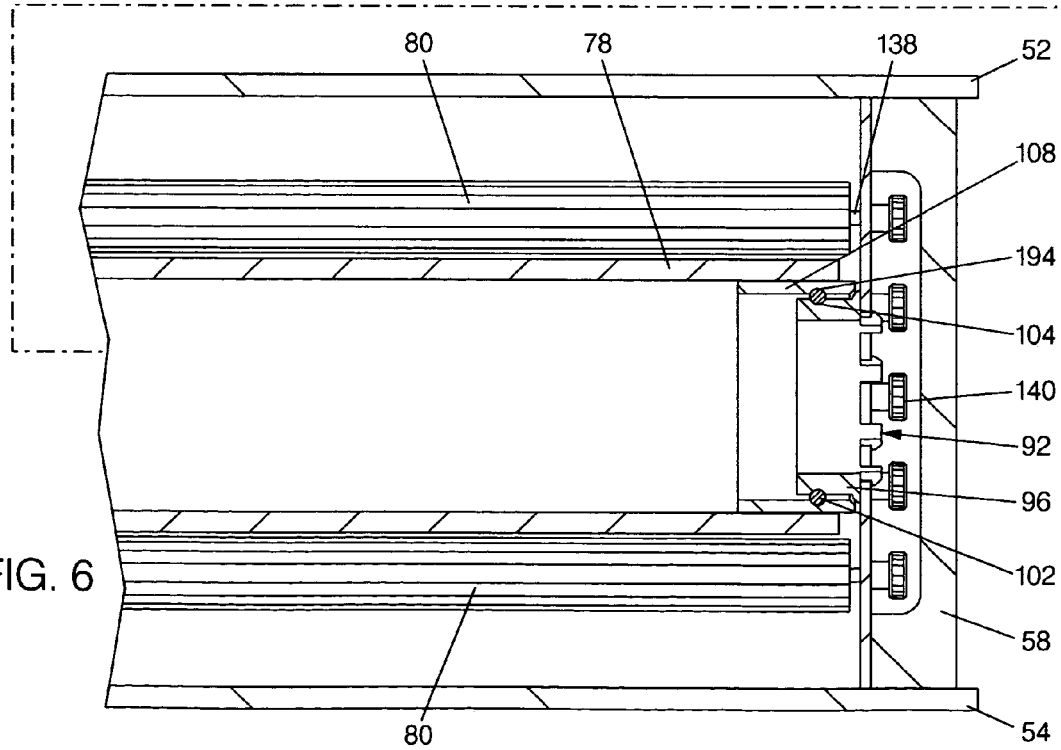
FIG. 6 is a foreshortened horizontal cross section view taken along section lines 5—5 and through the idler roller of FIG. 1. The dashed line indicates the relative orientation between FIGS. 5 and 6.

With attention to FIGS. 4, 5, and 6, the roller 78 is supported to the housing 64 with an active end cap assembly 90 and a passive end cap assembly 92. The assemblies 90 and 92 each provide a base or inner race piece 94 and 96 that are secured to opposite ends of the sash pieces 60 and 58. The base piece 94 is secured through an aperture 98 in a printed circuit board 100 that supports associated control circuitry of the roller assembly 78. Annular grooves 102 and 104 are formed into the inner race pieces 94 and 96 and receive bearings 102. The bearings 102 are captured between outer race pieces 106 and 108 and the inner race pieces 94 and 96 of the respective active end cap 90 and passive end cap 92. The outer race piece 106 is secured (e.g. press fit) into the end of the roller 78. The outer race piece 108 of the passive end cap 92 is loosely fit into the roller 78. The roller 78 is thus radially supported at both ends on two bearing surfaces and is free to rotate relative to the housing 64 via the active end cap assembly 90. The roller 78 is also able to expand or contract lengthwise relative to the housing 64 via the passive end cap assembly 92.

Mounted to the base piece 68 is a DC motor 110 that extends longitudinally into the hollow bore of the roller 78. The motor 110 is suitably selected and/or geared to accommodate the loading of the films 36–46. Depending upon the applications, a variety of different motor types 110 might be used with the roller assembly 76 (e.g. rheostat controlled motors, pulse modulated motors, or pulse width controlled motors) and/or the motor 110 may be mounted in an exposed condition.

It should be recognized that the torque requirements of the gearhead motor must provide sufficient lifting power to raise the total weight of the several films 36–46 and of their bottom weights 84. Further, a holding torque must be provided when the motor 110 stops, to lock the films 36–46 in place when the motor is "off". Such gearmotors with attached electrically operated brakes can be fitted into the end of the drive roller 78.

Alternatively and/or in combination, the passive end cap assembly 92 may incorporate a torsion spring of the type normally used to retract roller blinds, but without any ratchet assembly. This torsion spring can be pre-wound to balance the torque load of the weights 84 when the films 36–46 are wound up. As the films 36–46 move down to their fully lowered position, increasing in torque load, the torsion spring will increase in restoring torque. The torque constant per turn of the spring, and the number of turns of pre-wind, can permit an exact cancellation or counter-balance at both extremes of the film movement. The "hold" requirement with the motor turned "off" will be near zero with this counter-balance at any position of the films, and probably will eliminate the need for a brake assembled with the gearmotor.

A flexible drive coupling 112 of suitable construction connects the motor 110 to roller 78 as depicted in FIGS. 4 and 5. The drive coupling 112 is shown in detail in FIG. 5. The rotational output of an output shaft 114 of motor 110 is particularly transmitted via a drive hub 116, flexible member 118 and driven hub assembly 112. The connection of the hub assembly 112 to the roller 78 occurs at the interface with a number of compressed O-rings 120. The O-rings 120 are retained between an end clamp plate 124 that is secured with a screw 128 to the hub 130. A sleeve 112 is fit between the O-rings 120 and the clamp plate 124 such that drawing the plate 124 tight to the hub 130 compresses the O-rings 120. The expansion of the O-rings 120 produces a flexible gripping of the inside of the roller 78.

Although the window assembly 32 of FIGS. 1–16 depicts an assembled window of a specific square dimension (e.g. 40 inches) with six films 36–46 and having a 3½ inch airspace between the glazing layers 52 and 54, other window assemblies ranging from full ceiling height to widths of several feet can also be constructed using configurations comparable to the foregoing. Such windows may include more or less film layers and may also include intermediate immovable coated film or glazing layers to increase the R-value of the "open" widow. In the latter instance multiple roller assemblies 76 might be mounted in the housing 64 between the additional immovable film/glazing surfaces. In all cases however and even with the use of double or triple thickness glass, it is contemplated that the thickness of the window assembly 32 need not be more than about 4 inches, since an R19 rating is believed most practical and/or cost effective for most applications.

The multi-layered film window assembly 32 finds application in windows of all sizes. The smallest window applications are principally limited by the minimum physical size of the internal components. The largest window applications are similarly limited by the maximum available glass size and structural considerations of the framework 56 and roller assembly 76.

Figure 7:
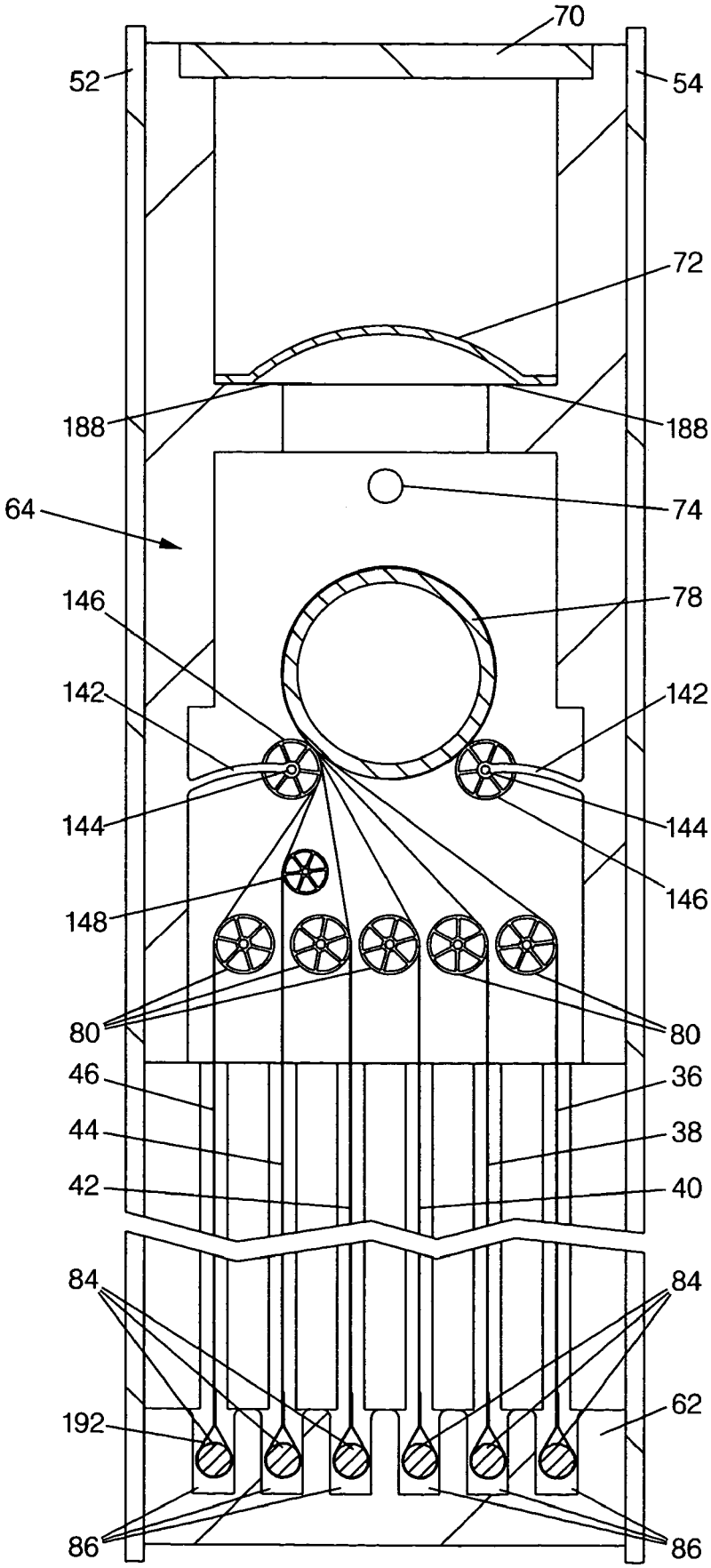
FIG. 7 is a foreshortened vertical cross section view taken along section lines 7—7 of FIG. 2.

To insure uniform performance for large width, multi-layered film window assemblies 32, several design features that can be selectively incorporated into any window assembly 32 are shown at FIG. 7. The primary concern is that as width increases so too does the potential for sagging of the primary roller 78 and secondary rollers 80. Any wrinkling of the outer visible films will be apparent to room occupants and/or passersby and will be particularly apparent if the outer films are specularly reflective.

One method to de-emphasize any such wrinkling is to provide the exterior film layers 36 and 46 with matte finishes. This will visually obscure the presence of sag-induced wrinkles.

Sagging at any of the rollers 78 and/or 80, and particularly at the primary roller 78, will cause wrinkling to occur in the films 36–46. Deflection of the primary roller 78 can be overcome increasing the roller's ability to resist deflection by increasing its stiffness, for example, by increasing its diameter to prevent the formation of wrinkles.

An alternative and preferred method that is suitable for any width of window 32 is shown in FIG. 7. This method utilizes a series of rollers 146 that turn on axles 144. Flanges 142 that extend from the front and rear walls 184 and 186 of the housing 64, in turn, support the axles 144. The rollers 146 exert an upward force on the primary roller 78. The width of the rollers 146 and the number and spacing between the rollers 146 can be determined empirically. The total upward force should compensate for the combined weights of the roller 78 and films 36–46 and the compensating forces should be applied to maintain uniformity over the entire length of the roller 78 in relation to other support considerations such as described above.

Another significant benefit of the support rollers 146 is that they form a barrier to circulating air currents from the exterior side of the outer film layers 36–46 to the interior layers. If left unimpeded, this air circulation could decrease the insulative properties of the assembly 32.

Another significant concern for wide window assemblies 32 is to prevent sagging in the film spreading rollers 80. The rollers 80 spread the films 36–46 as they unwind from the primary roller 78 and create the insulative dead air spaces 88 between the layers 36–46. Sagging in the rollers 80 can also lead to decreased system performance and visual distortions at the films. The rollers 80 are constructed from a light-weight material, such as extruded plastic. The bending resistance, or stiffness of such rollers is very low. If such a roller were supported only on its ends, significant sagging would occur even on relatively narrow windows. This sagging is prevented by using tensioned wires, strings, cables, or other similar tensioned strands strung between the sash pieces 58 and 60 as the axles 81 for the rollers 80. Such a tensioned axle 81 is able to resist the combined weight of the roller 80 and the overlying film. The use of tensioned axles 81 also allows the rollers 80 to be constructed as multiple short segments that are spaced apart and distributed over the width of each film layer 36–46.

Sagging at the roller might also be prevented by using multiple rollers 78 with the number of films divided between the rollers 78. One or more rigid or immobile films might depend from the housing 64 and be mounted between adjacent rollers 78 to span and segregate the interior space into multiple sections.

SYSTEM CONFIGURATION(S)

Figure 21:
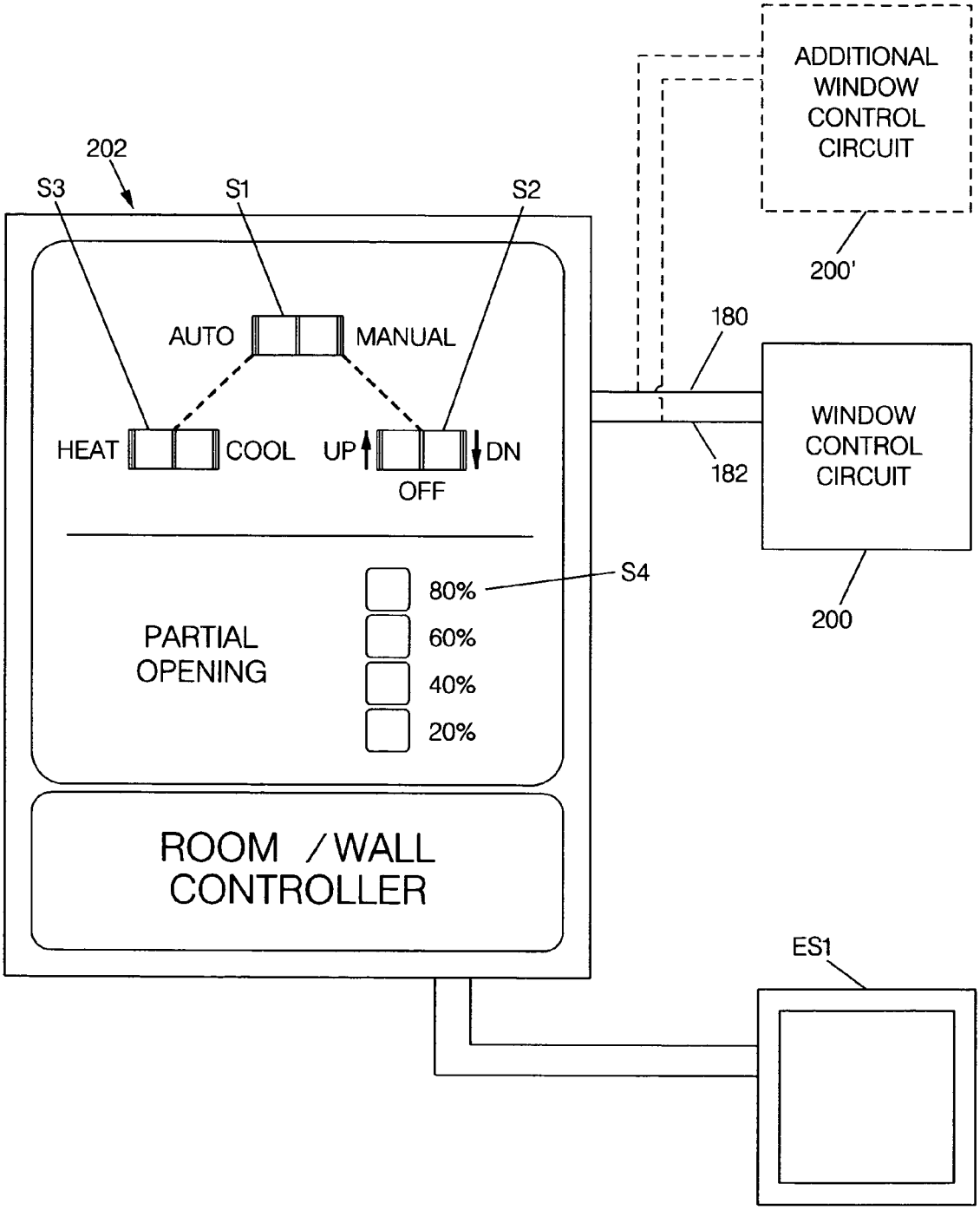
FIG. 21 is a block diagram of a typical single room/wall control system.
Figure 22:
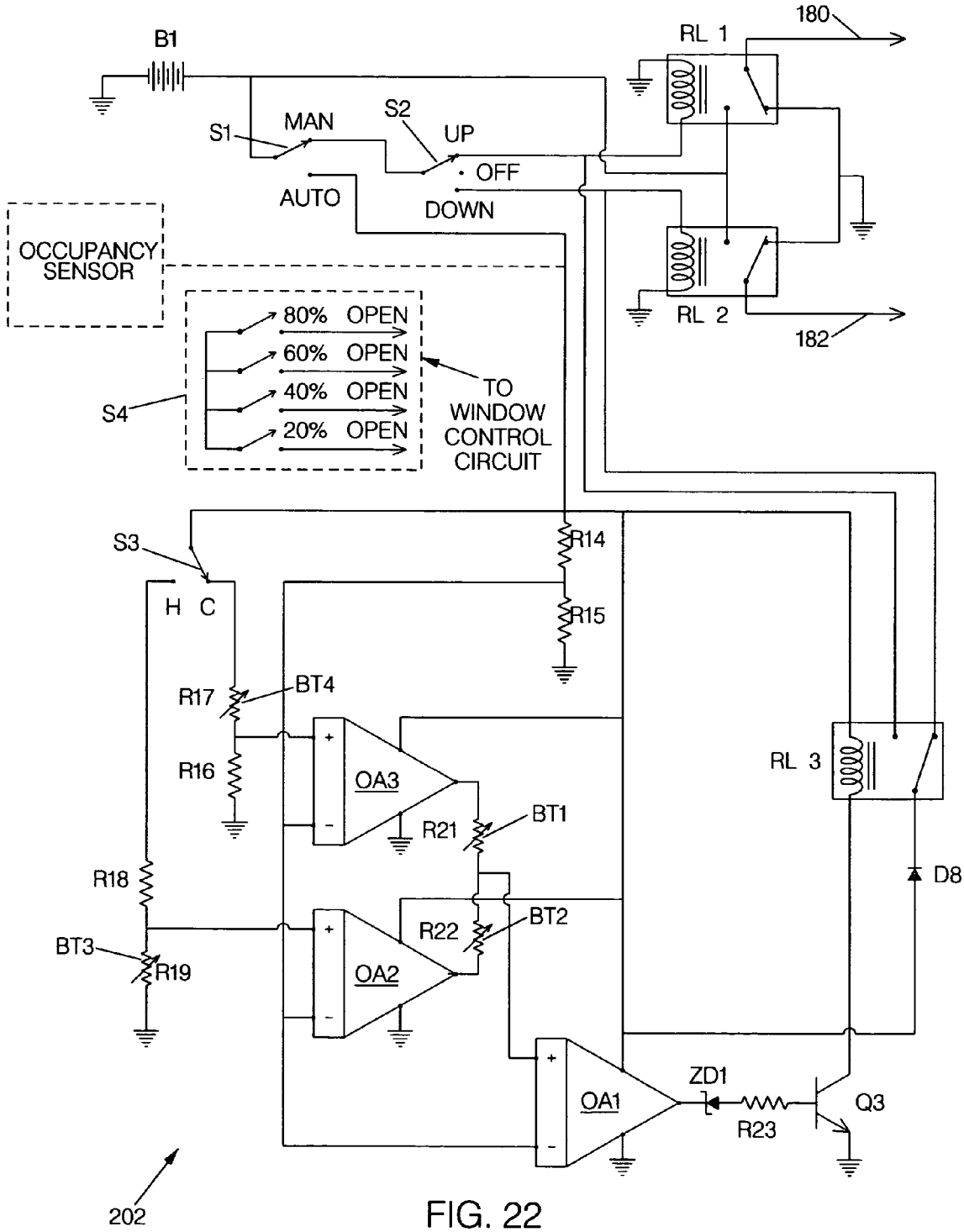
FIG. 22 is a schematic diagram of a single room controller.
Figure 23:
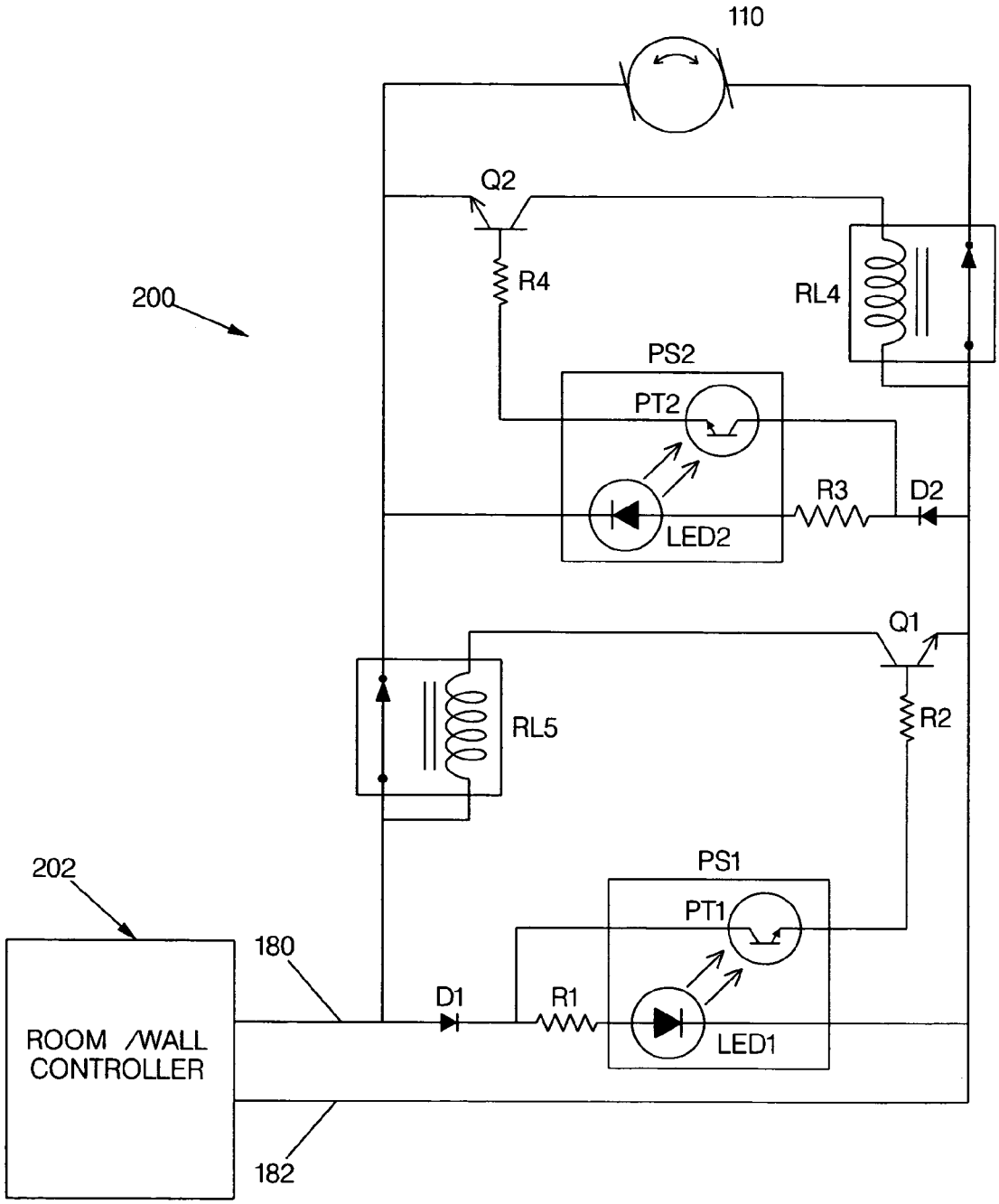
FIG. 23 is a schematic diagram of the window control circuitry.
Figure 24:
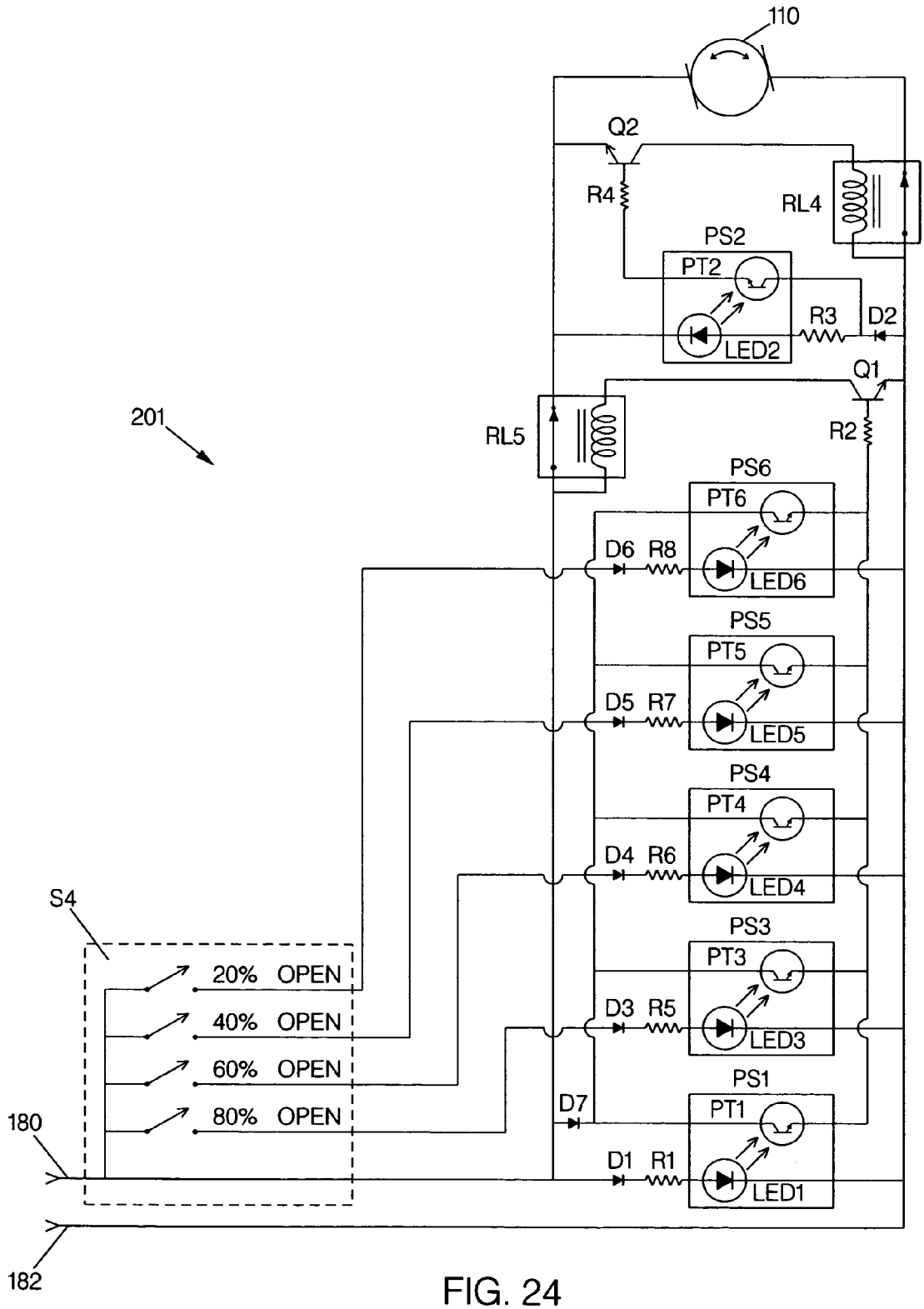
FIG. 24 is a schematic diagram of switch circuitry for controlling partial exposure of the window films.
Figure 26:
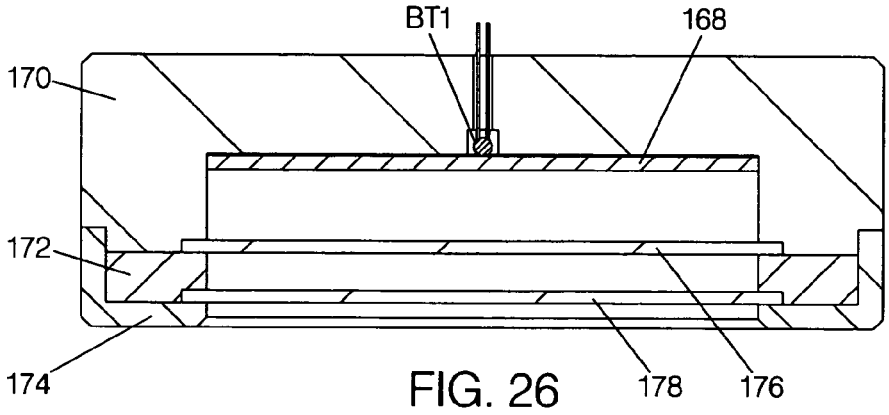
FIG. 26 is a horizontal cross section view taken along section lines 26—26 through FIG. 25.
Figure 25:
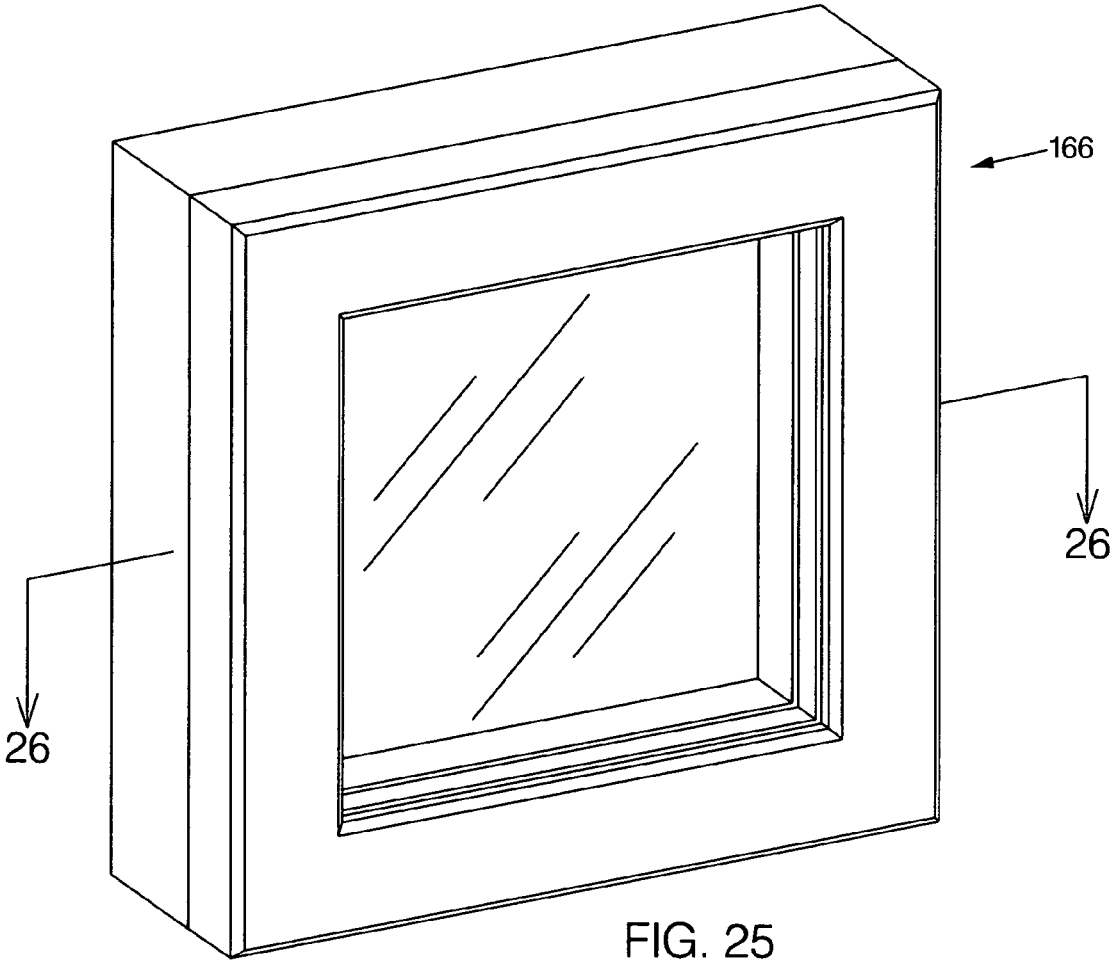
FIG. 25 is a perspective view of an external solar gain sensor assembly.

Turning attention to FIGS. 21–24, details are shown to a block diagram of a typical single room/wall control system (FIG. 21). A schematic diagram detailing the room/wall controller 202 is shown at FIG. 22. A schematic detailing an up/down, two-stop window control circuit 200 is shown at FIG. 23; and a schematic detailing a partial opening, multiple-stop window control circuit 201 is shown at FIG. 24. FIGS. 25 and 26 disclose details to a solar gain sensor ES1 used in association with the control system of FIG. 21.

The room/wall controller 202 of FIGS. 21–23 can be used to direct the control circuits 200 of one or several window assemblies 32. Additional window assemblies 32 and their controllers 200' can be added as desired in parallel to each other such as indicated in dashed line at FIG. 21. Low voltage DC wiring connects each of the desired windows 32 to the room/wall system controller 202.

In a typical system, the room/wall system controller 202 may be connected to operate the films 36–46 in unison to a desired lighting and thermal transfer condition for the windows along one wall or for an entire room. The exposure of the films 36–46 may be directed via provided switches in a range from fully extended to fully retracted or several intermediate conditions (e.g. 20%, 40%, 60%, 80%). An automatic mode as shown in FIG. 22 may also be selected and during which thermistors monitor internal and external solar-influenced temperatures (e.g. $T_i$ and $T_e$) to automatically direct film movement in relation to predetermined threshold conditions and external conditions to minimize heating or cooling requirements.

FIG. 22 depicts the circuitry of the controller 202, which is powered by a rechargeable DC power source B1, and which may typically be a battery of appropriate voltage (e.g. nominally 12.6 volts). An AC to DC power supply may also be used to power the circuitry. Multi-position switches S1, S2, and S3 control associated relays R1, R2, and R3. Switch S1 determines "manual" or "automatic" modes for film operating conditions. With switch S1 set to "Manual", switch S2 directs extension and retraction of the films. With S1 set to "Auto", switch S3 determines the system's response to monitored temperatures $T_i$ and $T_e$ described more fully below.

With the selection of the "Auto" condition, switch S3 is used to designate whether a winter "Heat" or a summer "Cool" mode of operation is desired. If the "Heat" mode is enabled, the in-room temperature $T_i$ is compared to an upper limit $T_M$. The output of operational amplifier OA2 will be near 12.6 volts if and only if "Auto" is selected, the "Heat" (winter) operating mode is selected and the in-room temperature $T_i$ is less than a maximum limit temperature $T_M$. The output of operational amplifier OA3 will be near 12.6 volts if and only if "Auto" is selected, the "Cool" (summer) operating mode is selected and the in-room temperature $T_i$ is greater than a lower limit $T_m$. For example, $T_i$ may be 70° F., $T_M$ may be 80° F. and $T_m$ may be 60° F.

While a variety of thermostatic means may be used to monitor temperatures and logically direct the operation of relays RL1 and RL2, the approach shown in FIG. 22 uses bead thermistors BT2, BT3, and BT4 to sense in-room temperature $T_i$ and, in following discussions, the exterior temperature $T_e$ by using BT1. Typically and for example, the resistance of such a sensor will vary as $$R(T)=R(To)-\alpha(T-To)=Ro-\alpha(T-To).$$

Where Ro in our example may be 12K at 70° F. and α may be 0.02/° F. Thus, a resistance of value $R_M$=10K will be reached at $T_M$=80° F. and a resistor of value $R_m$=14K will be reached at $T_m$=60° F. The circuit shown in FIG. 22 uses resistors in a Wheatstone Bridge arrangement to determine when operational amplifiers OA2 and OA3 will have a high saturated output voltage or whether their output will be near zero.

This bridge arrangement uses operational amplifiers with high gain and without feedback to compare input voltages to inverting and non-inverting inputs. If the battery voltage is VB1 and two resistors R14 and R15 are used, the inverting input will be $$v^-=VB1\times R15/(R14+R15)$$

Typically, VB1=12.6 and R14=R15=10K. The inverting input will then be held at 6.3 volts for OA1, OA2, and OA3. These amplifiers will switch to high saturation, typically above 11 volts, if $v^+$ exceed 6.3 volts.

The output of either OA2 or OA3 may thus be at high saturation if S3 is in either "Heat" or "Cool" mode and if the interior temperature is in the range where more heat is desired, with $T_i<T_M$, or room cooling is desired, with $T_i>T_m$. Resistors R18 and R16 are set to equal the expected resistances of BT3 and BT4 when the limit temperatures $T_M$ and $T_m$ are reached. Thus, for the case where $T_o$=70° F., $T_M$=80° F., and $T_m$=60° F., R18 may be set at 10K and R19 may be set at 14K.

If either OA2 or OA3 thus provides an output of near VB1, the other will be near zero. Then, with appropriate logic inversion dependent on whether "Heat" or "Cool" is selected by S3, the resistance values of two thermistors BT1 and BT2 will enable operational amplifier OA1 to control widow operation. Thermistor BT2 again measures interior room temperature; BT1 is mounted exterior to the room wall and sensed an available exterior temperature $T_e$.

A separate external sensor ES1, depicted in FIGS. 25 and 26, contains bead thermistor BT1. This sensor responds to sunlight and exterior ambient conditions (e.g. intensity and angle of sunlight incidence, exterior ambient temperature and wind condition) to define a temperature $T_e$. The ES1 sensor is designed to model the expected potential heat flow through each window 32 of a common wall or room in the "open" position (i.e. films 36–46 retracted). The $T_e$ and $T_i$ temperatures are appropriately compared to direct the operation of the relay RL3 and control the up/down position of the films 36–46. Ideally, the sensing of $T_e$ provides a response time sufficient to avoid intermittent (i.e. short duration) responses to passing clouds, shadows and the like.

The sensor ES1 is shown in FIGS. 25 and 26 and from which two leads are fed back to the room controller 202. The sensor ES1 provides a hermetically sealed enclosure constructed to contain bead thermistor BT1, absorber plate 168, insulated housing 170, glass 176, spacer 172, glass 178, and retainer 174. The glass layers 176 and 178 are placed above the absorber plate 168 and sealed by retainer 174. The absorber plate 168 is placed on insulated housing 170 and responds to external conditions to define the Te temperature via the bead thermistor BT1, which is attached to the absorber plate 168. The thickness of the absorber plate 168 can be adjusted to provide a suitable time constant to accommodate sporadic changes in solar incidence (e.g. approximately 10 minutes).

The temperatures $T_i$ and $T_e$ are reflected in the resistance values of the respective bead thermistors BT2 and BT1, where BT2 is contained in the room/wall controller 202. The bead thermistors BT1 and BT2 are coupled into a voltage divider arrangement as resistors $R_i$ and $R_e$ and the output of which is the non-inverting input to operational amplifier OA1. The output of the operational amplifier OA1, in turn, is used to control the voltage across the relay RL3 to direct the motion of window shades to a closed (down) or open (up) position.

The foregoing bridge configuration provides a logic inversion between summer and winter conditions since either OA2 or OA3 may be driven positive. The output of OA1 in turn determines whether a higher solar equivalent temperature $T_e$ compared to room temperature $T_i$ should open or close the films 36–46.

The operational amplifier OA1 will have an output usually near 12 volts when an "UP" state is desired or near 0 volts when a "DOWN" state is desired. The output of the amplifier OA1 is first compared to a mid-point voltage around 5.2 volts using Zener Diode ZD1. It is then directed through base resistor R23 and amplified using transistor Q3 and relay RL3. A diode D8 is incorporated in the path through relay RL3 to block voltage from returning to the "Auto" circuit during "Manual" operation of relays RL1 and RL2.

An "UP" state is designated whenever 1) "Auto" and "Heat" are selected, $T_i$ is less than $T_M$, and $T_i$ is less than $T_e$; or 2) "Auto" and "Cool" are selected, $T_i$ is greater than $T_m$, and $T_i$ is greater than $T_e$. Typically, the conditions for (1) are satisfied when sunlight is shining on ES1 in the winter. During the heating season, walls not exposed to sunlight will usually have their films 36–46 lowered to present a darkened or mirror-like wall rather than a window. At night and in Auto mode, all films 36–46 will typically be lowered. The conditions for (2) are satisfied during the summer and only during cool nighttime hours in the hot part of the air-conditioning season.

While not explicitly shown in the control circuitry of FIG. 22, it is to be appreciated that an occupancy sensor (shown in dashed line) can be coupled to enable the Auto mode at any time the room is empty for any extended period. This option is coupled to override the UP and DOWN settings and enable AUTO setting whenever the room is unoccupied. Once occupancy is sensed, the controller 202 reverts to the previous setting.

The output of the room/wall controller 202 provides two logic states, either 0 volts (ground) or 12.6 volts (VB1). Relays RL1 and RL2 are configured as SPDT devices and induce a "shade UP" condition via conductor 180 and a "shade DOWN" condition via conductor 182. Both conductors 180 and 182 may be at 0 volts, but both will never simultaneously be at 12.6 volts. The output(s) of the room/wall controller 202 are thus fed to all window units 32 via the low voltage conductors 180 and 182.

The control circuit 200 for each window is shown at FIG. 23. The control circuit operates to direct the motor 110, which in the present assembly 32 is a geared, permanent magnet DC motor. As mentioned, the motor 110 is preferably housed in the hollow bore of the primary roller 78. Photo sensors PS1 and PS2 are mounted near the roller 78, see FIGS. 3 and 4, and biased via resistor-diode combinations R1–D1 and R3–D2 to monitor film movement and provide upper and lower movement limits. The photo sensors PS1 and PS2 include infrared, LED photodiodes LED1 and LED2. The photodiodes LED1 and LED2 are aligned to indicia or voids at the edges of one or more of the films 36–46 and phototransistors PT1 and PT2. The indicia can comprise suitably coated materials or abraded portions of the low-emissivity metal coatings at the films 36–46. The indicia and phototransistors PT1 and PT2 can be located as desired at one or multiple films. The inner films 38 and 44 were presently selected over the outermost films 36 and 46 to prevent viewing the abraded areas.

Activation of either of the phototransistors PT1 and PT2, the outputs of which are amplified with transistors Q1 and Q2, engages (i.e. opens) an associated relay RL4 or RL5 to appropriately control the motor 110. The relay RL5 is coupled to provide an upper motion stop and the relay RL4 is coupled to provide a lower motion stop.

The diodes D1 and D2 are provided to block a potential breakdown when a reverse bias is applied to either phototransistor PT1 or PT2. The phototransistors PT1 and PT2 typically have reverse voltage ratings of only several volts. Resistors R1 and R3 limit the forward current through LED1 and LED2 respectively and resistors R2 and R4 limit the base current of transistors Q1 and Q2.

Returning attention to FIGS. 21 and 22 and with additional attention to FIG. 24, for certain situations it may be preferred that the films 36–46 be controlled to one or more intermediate positions to permit the passage of some outside light. The switch S4 is provided to this end and wherein one of several additional phototransistors PT3–PT6 and biasing resistors (e.g. R5–R8) and diodes (e.g. D3–D7) are associated with each of the films 36, 40, 42 and 46. Appropriate sensing indicia are provided at the films 36, 40, 42 and 46 to permit controlling the films in 20% increments.

The switch S4 is configured to require that the films 36–46 must have been commanded "Down" using switch S2 before the switch S4 can enable partial exposure conditions. If a given one of the intermediate positions is selected by the optional switch S4 of FIG. 24 when the shades are already above that point, the operation of gear motor 110 will still cease when the upper limit is sensed by PS1. Random, intermediate film exposure conditions can be provided with the inclusion of additional control circuitry.

It should be emphasized that the details of the circuitry and operating points shown in FIGS. 21 through 26 are exemplary and alternative control schemes could be adapted for use with the improved window assembly 32. For example, some modifications may include some or all of the following:

1. A torsion spring may be mounted in the free hollow end of roller assembly 78, replacing passive end cap 92, to counter-balance the torque tending to pull down the weighted films. For a given window height and width, the values of the downward torque of the weighted films at the two end positions (fully "up" and fully "down") are determined. The torque constant per turn of the spring and the number of pre-load spring turns can be designed to match the end positions. The gearhead motor will then have very low torque requirements to move "up" or "down" over the entire opening range. With the gearhead motor turned off, no net torque will lead to motion at either end position.

2. The use of magnetizable steel rods for weights 84 at the bottom of the several films would facilitate the use of small permanent magnets mounted in the side frame pieces 58 and 60 to "hold" the films at all of the desired stop points set by switch S4.

3. Thermocouples may be used to sense the temperature difference between one blackened surface just inside the outer glazing of one window and another just outside the inner glazing of the same window. As an example, a copper path might lead from one blackened copper sensor and back from the second with a different metal, such as constantan, leading between the two sensors. Operational amplification of that (much smaller) differential thermocouple voltage could replace the bead thermistors BT1 and BT2, and the separate packaging of the outside sensor shown in FIG. 26.

4. The sensing of the position of the film layers could be done using mechanical micro switch sensing, or magnetic reed switch sensing of affixed magnetized tabs on the films for end of travel and even for intermediate positions, rather than the use of photo sensors looking for openings in the opaque films on individual shades.

5. Microprocessor controllers and stepper, servo, or encoder motors could provide for the precise positioning of the film layers and ranging from fully open to fully closed conditions.

6. Set points with different limit temperatures $T_M$ set for winter and $T_m$ set for summer could be established by factory-set, or field-set, input temperature values which could be used with clock and calendar-generated commands replacing selection of "winter" or "summer". This would be of particular use with microprocessor control; one bead thermistor could sense interior temperature and select appropriate operating mode without any operator intervention. Alternatively, a logic-based control system could replace manual or calendar-generated commands and automatically determine the appropriate system responses in order to maintain maximum effectiveness.

7. Hard-wire control of window units, and even the feed of power to the units, could be replaced by optical paths. That is, solar cells mounted inside the exterior window glazing could provide sufficient storable energy to operate motors (e.g. gear or direct drive; AC or DC; servo, stepper, or encoder); wireless remote controls could command window shade operations so that no external paths would be required to a given window.

8. Many commercial and industrial buildings use occupancy sensors to turn off lights in any room not occupied for a set time, thus saving the cost of lighting. It would be quite easy to incorporate one path to sense such lighting voltage in the room/wall controller 202. A "lights out" command could then set the master control to the "Auto" position.

9. Master control of entire walls and/or entire buildings could be incorporated enabling authorized personnel the ability to remotely raise or lower any or all shades fully or partially, set control parameters such as auto/manual/off, or test the operation of specific units for maintenance purposes.

While the invention has been described with respect to a number of preferred assemblies and considered improvements, modifications and/or alternatives thereto, still other assemblies and may be suggested to those skilled in the art. It is also to be appreciated that selected ones of the foregoing assemblies and/or features can be used singularly or can be arranged in different combinations. The foregoing description should therefore be construed to include all those embodiments within the spirit and scope of the following claims.

What is claimed is:

1. A window comprising:

a) a sash framework comprising a plurality of sash pieces mounted to define an endless perimeter and wherein first and second glazing pieces are mounted to cover said framework to define an airtight interior primary space;

b) a roller assembly mounted within said primary space and including a plurality of roller members mounted to said framework to span between opposed first and second sash pieces;

c) a plurality of films secured to said roller assembly and each film mounted to respectively engage one of said roller members and wherein said plurality of films are mounted for reciprocating movement and said roller members displace said plurality of films apart in planar parallel relation from one another and from said first and second glazing pieces to define a plurality of non-convective dead airspaces between adjacent ones of said plurality of films and said first and second glazing pieces.

2. A window as set forth in claim 1 including motorized means coupled to said roller assembly for extending and retracting said plurality of films.

3. A window system including a plurality of windows as set forth in claim 2 mounted to a building and further including:

a) sensor means for monitoring a thermal condition in a building space containing said windows and a solar condition representative of solar energy incident on said plurality of windows; and b) control means responsive to the sensor means and coupled to the roller assembly of each of said plurality of windows for selectively extending and retracting the plurality of films of each of said plurality of windows to maintain a determined thermal condition in the building space.

4. A window system as set forth in claim 3 comprising:

a) a first sensor for monitoring an interior temperature and a second sensor monitoring solar energy flow through said plurality of windows; and b) a processor responsive to the interior temperature, maximum and minimum interior temperatures and a parameter directly correlated with heat flow through said windows for directing movement of said plurality of films of each of said windows to maintain an internal temperature intermediate said maximum and minimum temperatures.

5. A window system as set forth in claim 4 including means for monitoring the occupancy of a space including said plurality of windows and for responsively reverting between user defined and predetermined maximum and minimum temperatures.

6. A window system as set forth in claim 3 wherein said sensor means includes a plurality of thermistors coupled to sense a temperature within the building space and solar radiation incident on said plurality of windows.

7. A window system as set forth in claim 3 including means defining a plurality of predetermined exposure conditions for said plurality of films of each window.

8. A window as set forth in claim 1 wherein said roller assembly includes a hollow primary roller and wherein said plurality of films are mounted to said primary roller and a motor is coupled to the interior of said primary roller to rotate said primary roller to extend and retract said plurality of films.

9. A window as set forth in claim 1 wherein said plurality of roller members comprise a plurality of cylindrical members a plurality of guide rollers mounted to said framework to support said plurality of films.

10. A window as set forth in claim 9 wherein each of said plurality of cylindrical members is mounted to a filamentary axle.

11. A window as set forth in claim 1 wherein said opposed first and second sash pieces include a plurality of channels and wherein said roller members train peripheral edges of each of said plurality of films in said channels.

12. A window as set forth in claim 1 including means for monitoring changing solar radiation conditions external to an enclosed building space containing said window and wherein a motorized means coupled to said roller assembly responsively controls the movement of said plurality of films between retracted and extended conditions.

13. A window as set forth in claim 12 including means for monitoring movement of said plurality of films and limiting the movement to a plurality of predetermined stop points that define selected exposures.

14. A window as set forth in claim 1 wherein said roller assembly includes a primary roller, wherein said plurality of films are mounted to said primary roller, and wherein a plurality of rollers abut said primary roller.

15. A window as set forth in claim 1 wherein said plurality of roller members each exhibit an elongated arcuate surface that respectively engage one of said plurality of films, wherein said first and second sash pieces mounted substantially parallel to each other include a plurality of channels, and wherein peripheral edges of each of said plurality of films are respectively contained in said channels.

16. A window as set forth in claim 15 wherein a sash piece mounted transverse to said first and second sash pieces includes a plurality of channels and wherein a peripheral end edge of each of said plurality of films respectively mounts to a channel of the transverse sash piece when said plurality of films are in a fully extended condition.

17. A window as set forth in claim 1 including an expansible member mounted in said primary space to said framework to define a secondary interior space and wherein said expansible member is mounted to flex with pressure changes within the primary space.

18. A window as set forth in claim 1 including means for applying tension to each of said plurality of films.

19. A window as set forth in claim 18 wherein a member is secured to each of said plurality of films to maintain each of said films in a taut, substantially unwrinkled condition.

20. A window as set forth in claim 1 including an immobile film mounted between said first and second glazing pieces in parallel relation to said first and second glazing pieces.

21. A window as set forth in claim 1 wherein each of said plurality of films is coated with a material to provide a low-emissivity and high solar reflectance.

22. A window as set forth in claim 1 wherein said roller assembly includes a primary roller comprising a tubular member having a bore, a motor contained within said bore, and a coupler mounted to said motor and restrained to said tubular member to rotate said tubular member and thereby extend and retract said plurality of films.

23. A window as set forth in claim 22 wherein a plurality of rollers compressively abut and support said tubular member.

24. A window as set forth in claim 22 including an end cap secured to said framework at an end of said tubular member opposite to that containing said motor and mounted to rotate and permit the lateral movement of said tubular member.

25. A window as set forth in claim 1 wherein one of said plurality of films is attached to a primary roller of said roller assembly and each of the others of said films are secured to the attached film.

26. A window as set forth in claim 1 wherein a film attachment piece is secured to a primary roller of said roller assembly and each of said plurality of films is secured to said attachment piece.

27. A window as set forth in claim 26 wherein said film attachment piece includes a plurality of slits, whereby wrinkling is prevented at said plurality of films.

28. A window as set forth in claim 1 including a film attachment piece having a plurality of tabs and notches mounted to a primary roller of said roller assembly and wherein said plurality of films are mounted to said film attachment piece.

29. A window as set forth in claim 1 including a bellows mounted within said primary space and having a vent tube communicating with an interior space of said bellows to expand and contract with pressure changes within said primary space.

30. A window as set forth in claim 1 including an expansible member mounted within said primary space to define a secondary space between a sash piece and said roller assembly and including a vent port communicating with said secondary space and an external space, whereby said expansible member expands and contracts with pressure changes within said primary space.

31. A window as set forth in claim 1 including:

a) sensor means for monitoring an internal thermal condition in a building containing said window relative to a solar condition representative of solar radiation incident on said window; and b) control means responsive to said sensor means and coupled to said roller assembly for selectively extending and retracting said plurality of films to determined exposure conditions.

32. A window comprising:

a) a framework comprising a plurality of sash pieces mounted to define an endless perimeter and wherein first and second glazing pieces are mounted to cover said framework to define an airtight interior primary space, wherein opposed, parallel first and second sash pieces include a plurality of parallel coextending guide channels, and wherein first and second glazing pieces are mounted to said framework to contain a gas within said primary space;

b) a roller assembly supported within said primary space and mounted to span between said first and second sash pieces, wherein a plurality of films are secured to said roller assembly and mounted for reciprocating movement in planar parallel relation to said first and second glazing pieces and one another to define a plurality of non-convective dead airspaces between adjacent ones of said plurality of films and said first and second glazing pieces, wherein a plurality of guide rollers respectively support and train peripheral edges of each of said plurality of films in said guide channels.

33. A window as set forth in claim 32 including an expansible membrane mounted within said framework and defining a secondary space, wherein said secondary space is vented to the external environment and wherein said expansible member expands and contracts with pressure changes within said primary space.

34. A window as set forth in claim 32 wherein said roller assembly includes a primary roller and an attachment piece mounted to said primary roller, wherein said attachment piece includes a plurality of slits, and wherein said plurality of films are secured to said attachment piece.

35. A window comprising:

a) a framework comprising a plurality of sash pieces mounted to define an endless perimeter, wherein said sash pieces include a plurality of channels, and wherein first and second glazing pieces are mounted to said framework to define an airtight interior primary space;

b) a roller assembly mounted within said primary space to span between first and second opposed sash pieces, wherein a plurality of films coated with a material to provide a low-emissivity and high solar reflectance are secured to a primary roller, wherein said framework includes a plurality of guide members mounted to said first and second sash pieces to respectively support and train an edge portion of each of said plurality of films in one of said channels for reciprocating movement in planar parallel, non-wrinkling relation to said first and second glazing pieces and one another to define a plurality of non-convective dead airspaces between adjacent ones of said plurality of films and said first and second glazing pieces.

36. A window as set forth in claim 35 including means for monitoring changing thermal conditions within a building space containing said window and thermal energy transfer through said window and including motorized means for extending and retracting said plurality of films, and wherein said motorized means responsively controls the movement of said plurality of films between retracted and extended conditions to maintain internal thermal conditions between defined minimum and maximum thermal parameters.

37. A window as set forth in claim 35 including means for monitoring movement of said plurality of films.

38. A window as set forth in claim 35 including a plurality of rollers mounted to abut and support said primary roller.

39. A window as set forth in claim 35 wherein at least one guide member comprises a plurality of displaced roller segments distributed over the width of an adjoining film.

40. A window as set forth in claim 35 including an expansible member mounted to said framework to define an interior secondary space and wherein said expansible member expands and contracts with pressure changes within the interior primary space.

41. A window as set forth in claim 35 including:

a) sensor means for monitoring an internal thermal condition in a building containing said window relative to a solar condition representative of solar radiation incident on said window; and b) control means responsive to said sensor means and coupled to said motorized means for selectively extending and retracting said plurality of films to determined exposure conditions.

42. A window as set forth in claim 35 including means for applying tension to each of said plurality of films.

43. A window assembly comprising:

a) a framework comprising a plurality of sash pieces mounted to define an endless perimeter and wherein first and second glazing pieces are mounted to cover said framework to define an airtight interior primary space, and wherein first and second glazing pieces are mounted to said framework to define an airtight interior primary space;

b) an elongated expansible membrane having a U-shape when viewed end-on mounted to said framework to define a secondary interior space coupled to an environment external to said framework and mounted to flex with pressure changes within the interior primary space c) a roller assembly supported in said framework, wherein said roller assembly substantially spans the space between said first and second opposed sash pieces;

d) a plurality of films secured to said roller assembly, wherein each of said plurality of films is coated with a material to provide a low-emissivity and high solar reflectance and wherein said plurality of films are mounted for reciprocating movement in planar parallel relation to said first and second glazing pieces and to one another to define a plurality of non-convective dead airspaces between adjacent ones of said plurality of films and said first and second glazing pieces;

e) means for applying tension to each of said plurality of films;

f) motorized means for extending and retracting said plurality of films; and g) means for retaining said plurality of films without wrinkling in planar parallel relation to one another and to said first and second glazing pieces.

44. A window as set forth in claim 43 wherein said roller assembly comprises a tubular member having a bore, a motor secured to said framework and contained within said bore, a coupler mounted to said motor and restrained to the interior of said tubular member to induce the rotation of said tubular member.

45. A window as set forth in claim 43 wherein a plurality of rollers abut and support said tubular member.

46. A window comprising:

a) a framework comprising a plurality of sash pieces mounted to define an endless perimeter and wherein first and second glazing pieces are mounted to cover said framework to define an airtight interior primary space;

b) a roller assembly supported in said primary space and including a plurality of guide rollers mounted to span between opposed first and second sash pieces; and c) a plurality of films secured to said roller assembly wherein each of said guide rollers respectively supports one of said plurality of films and wherein said plurality of films, are mounted for reciprocating movement in planar parallel relation to said first and second glazing pieces and to one another to define a plurality of non-convective dead airspaces between adjacent ones of said plurality of films and said first and second glazing pieces.

47. A window comprising:

a) a framework comprising a plurality of sash pieces mounted to define an endless perimeter, wherein first and second glazing pieces are mounted to cover said framework to define an airtight interior primary space, and wherein opposed first and second sash pieces each include a plurality of parallel channels;

b) a roller assembly supported in said primary space, wherein said roller assembly substantially spans the space between said first and second sash pieces;

c) a plurality of films secured to said roller assembly, wherein displaced peripheral edges of each of said plurality of films are respectively contained in said channels, and wherein said plurality of films are mounted for reciprocating movement in planar parallel relation to said first and second glazing pieces and to one another to define a plurality of non-convective dead airspaces between adjacent ones of said plurality of films and said first and second glazing pieces.

48. A window comprising:

a) a framework comprising a plurality of sash pieces mounted to define an endless perimeter, wherein first and second glazing pieces are mounted to cover said framework to define an airtight interior primary space, and wherein an expansible member is mounted to said framework to define a secondary interior space and to flex with pressure changes within the primary space;

b) a roller assembly supported in said primary space, wherein said roller assembly substantially spans between opposed first and second sash pieces;

c) a plurality of films secured to said roller assembly and wherein said plurality of films are mounted for reciprocating movement in planar parallel relation to said first and second glazing pieces and to one another to define a plurality of non-convective dead airspaces between adjacent ones of said plurality of films and said first and second glazing pieces.

49. A window as set forth in claim 48 wherein said expansible member defines a peripheral edge portion of said primary space and including a vent port communicating between said secondary space and an environment external to said framework, whereby said expansible member expands and contracts with pressure changes within said primary space.

50. A window comprising:

a) a framework comprising a plurality of sash pieces mounted to define an endless perimeter, wherein first and second glazing pieces are mounted to cover said framework to define an airtight interior primary space;

b) a roller assembly supported in said primary space, wherein said roller assembly substantially spans between opposed first and second sash pieces, and wherein a primary roller includes a flexible attachment piece; and c) a plurality of films secured to said attachment piece such that rotation of said primary roller extends and retracts said plurality of films in planar parallel relation to said first and second glazing pieces and to one another to define a plurality of non-convective dead airspaces between adjacent ones of said plurality of films and said first and second glazing pieces.

51. A window comprising:

a) a framework comprising a plurality of sash pieces mounted to define an endless perimeter, wherein first and second glazing pieces are mounted to cover said framework to define an airtight interior primary space;

b) a roller assembly supported in said primary space, wherein said roller assembly substantially spans between opposed first and second sash pieces, wherein a primary roller includes an attachment piece having a plurality of tabs and intermediate notches, and wherein said tabs are secured to said roller; and c) a plurality of films secured to said attachment piece such that rotation of said primary roller extends and retracts said plurality of films in planar parallel relation to said first and second glazing pieces and to one another to define a plurality of non-convective dead airspaces between adjacent ones of said plurality of films and said first and second glazing pieces.

52. A window system including a plurality of windows:

a) wherein at least one window comprises;

i) a framework comprising a plurality of sash pieces mounted to define an endless perimeter, wherein first and second glazing pieces are mounted to cover said framework to define an airtight interior primary space;

ii) a roller assembly supported in said primary space, wherein said roller assembly substantially spans the space between opposed first and second sash pieces;

iii) a plurality of films secured to said roller assembly and wherein said plurality of films are mounted for reciprocating movement in planar parallel relation to said first and second glazing pieces and to one another to define a plurality of non-convective dead airspaces between adjacent ones of said plurality of films and said first and second glazing pieces;

b) sensor means including a plurality of thermistors monitoring a thermal condition in a building space containing said windows and a solar condition representative of solar energy passing through said plurality of windows; and c) control means responsive to said sensor means and coupled to the roller assembly of said at least one window for selectively extending and retracting the plurality of films to control the exposure of said plurality of films and the thermal condition.

53. A window comprising:

a) a framework comprising a plurality of sash pieces mounted to define an endless perimeter, wherein first and second glazing pieces are mounted to cover said framework to define an airtight interior primary space;

b) a roller assembly supported in said primary space, wherein said roller assembly substantially spans between opposed first and second sash pieces; and c) a plurality of films secured to a primary roller of said roller assembly, wherein a plurality of rollers abut and support said primary roller, and wherein said plurality of films are mounted for reciprocating movement in planar parallel relation to said first and second glazing pieces and to one another to define a plurality of non-convective dead airspaces between adjacent ones of said plurality of films and said first and second glazing pieces.

54. A window comprising:

a) a framework comprising a plurality of sash pieces mounted to define an endless perimeter, wherein first and second glazing pieces are mounted to cover said framework to define an airtight interior primary space;

b) a roller assembly supported in said primary space, wherein said roller assembly substantially spans the space between opposed first and second sash pieces;

c) a plurality of films secured to said roller assembly and wherein said plurality of films are mounted for reciprocating movement in planar parallel relation to said first and second glazing pieces and to one another to define a plurality of non-convective dead airspaces between adjacent ones of said plurality of films and said first and second glazing pieces.

d) motorized means for extending and retracting said plurality of films between a plurality of stop points defining predetermined film exposure conditions;

e) sensor means for monitoring a thermal condition in a building space containing said window and a solar condition representative of solar energy passing through said window; and f) control means responsive to said sensor means and coupled to said motorized means for extending and retracting the plurality of films to said stop points.

55. A window comprising:

a) a framework comprising a plurality of sash pieces mounted to define an endless perimeter, wherein first and second glazing pieces are mounted to cover said framework to define an airtight interior primary space;

b) a roller assembly supported in said primary space, wherein said roller assembly substantially spans between opposed first and second sash pieces;

c) an immobile film mounted in said primary space between said first and second glazing pieces; and d) a plurality of mobile films secured to said roller assembly and wherein said plurality of mobile films are mounted for reciprocating movement in planar parallel relation to said first and second glazing pieces and to one another to define a plurality of non-convective dead airspaces between adjacent ones of said plurality of films, said first and second glazing pieces and said immobile film.

56. A window comprising:

a) a sash framework comprising a plurality of sash pieces mounted to define an endless perimeter and wherein first and second glazing pieces are mounted to cover said framework to define an airtight interior primary space;

b) a roller assembly mounted within said primary space and including a plurality of guide members mounted to said framework to span between parallel opposed first and second sash pieces and wherein each guide member exhibits an elongated arcuate exterior surface;

c) a plurality of films secured to said roller assembly and each film mounted to respectively engage one of said guide members and wherein said plurality of films are mounted for reciprocating movement and said guide members displace said plurality of films apart in planar parallel relation from one another and from said first and second glazing pieces to define a plurality of non-convective dead airspaces between adjacent ones of said plurality of films and said first and second glazing pieces.

* * * * *